US010589889B2

(12) United States Patent
Saccardi

(10) Patent No.: US 10,589,889 B2
(45) Date of Patent: Mar. 17, 2020

(54) LABELLING MACHINE

(71) Applicant: KOSME S.R.L. UNIPERSONALE, Roverbella (MN) (IT)

(72) Inventor: Giovanni Saccardi, Malavicina di Roverbella (IT)

(73) Assignee: KOSME S.R.I. UNIPERSONALE, Roverbella (IT)

( * ) Notice: Subject to any disclaimer, the term of this patent is extended or adjusted under 35 U.S.C. 154(b) by 267 days.

(21) Appl. No.: 15/532,782

(22) PCT Filed: Mar. 4, 2015

(86) PCT No.: PCT/IB2015/051587
§ 371 (c)(1),
(2) Date: Jun. 2, 2017

(87) PCT Pub. No.: WO2016/139508
PCT Pub. Date: Sep. 9, 2016

(65) Prior Publication Data

US 2017/0334595 A1 Nov. 23, 2017

(51) Int. Cl.
*B65C 9/06* (2006.01)
*B41J 3/407* (2006.01)

(52) U.S. Cl.
CPC ..... *B65C 9/065* (2013.01); *B41J 3/4075* (2013.01)

(58) Field of Classification Search
CPC . B65C 9/06; B65C 9/065; B65C 9/067; B41J 3/4075
See application file for complete search history.

(56) References Cited

U.S. PATENT DOCUMENTS 4,487,650 A 12/1984 Mohn et al.
8,991,589 B2 3/2015 Marcantoni et al.
(Continued)

FOREIGN PATENT DOCUMENTS

DE 20019062 U1 12/2001
DE 102005041497 A1 3/2007
(Continued)

*Primary Examiner* — Philip C Tucker
*Assistant Examiner* — John Blades
(74) *Attorney, Agent, or Firm* — Pearne & Gordon LLP

(57) ABSTRACT

This disclosure relates to a labelling machine (1), comprising a carousel (3) rotatably mounted a supporting frame (2) in such a way that it can rotate about a first axis of rotation (30) and a plurality of supporting elements (4) for articles to be labelled (9). The supporting elements (4) are mounted on the periphery of the carousel (3) and are able to rotate about respective second axes of rotation (40). The machine (1) is characterised in that it comprises an operating unit (55) which is mounted on a rotary support (6) mounted on the supporting frame (2). The support (6) is able to rotate about a third axis of rotation (60) which is at a distance, along a radial line, from the first axis of rotation (30). The carousel (3) is movable relative to the third axis of rotation (60) and the operating unit (55), which is rotatable together with the rotary support (6), is designed to perform an operation on a lateral surface of an article (9) which is on its operating line when the article (9), positioned on a respective supporting element (4), passes near to the operating unit (55) during the rotation of the carousel (3). The rotation of the rotary support (6) about the third axis of rotation (60) is coordinated with the rotation of the carousel (3) about the first axis of rotation (30), whereby, in use, the rotation of the rotary support (6) about the third axis of rotation (60) keeps the operating unit (55) with the operating line towards the article to be labelled (9) along a stretch of angular movement of the carousel (3) about the first axis of rotation (30).

20 Claims, 15 Drawing Sheets

(56) References Cited

U.S. PATENT DOCUMENTS

| | | | | |
|---|---|---|---|---|
| 9,221,275 | B2 | 12/2015 | Till | |
| 9,862,515 | B2 * | 1/2018 | Pedercini | B65C 9/067 |
| 2007/0157559 | A1 | 6/2007 | Till | |
| 2009/0145511 | A1 | 6/2009 | Till | |
| 2011/0180975 | A1 * | 7/2011 | Hausladen | B29C 49/2408<br>264/509 |
| 2012/0147360 | A1 * | 6/2012 | Germini | B65C 9/067<br>356/138 |
| 2012/0199021 | A1 * | 8/2012 | Till | B41J 3/4073<br>101/36 |
| 2013/0292230 | A1 * | 11/2013 | Marcantoni | B65C 9/067<br>198/502.3 |
| 2015/0033965 | A1 * | 2/2015 | Knott | B41F 17/00<br>101/36 |

FOREIGN PATENT DOCUMENTS

| | | | | | |
|---|---|---|---|---|---|
| DE | 102011009393 | A1 | | 7/2012 | |
| DE | 102013215638 | A1 | | 2/2015 | |
| EP | 1806233 | A1 | | 7/2007 | |
| FR | 2021430 | | * | 7/1970 | B67B 3/00 |
| GB | 2137154 | A | | 10/1984 | |
| WO | 2012090093 | A1 | | 7/2012 | |

* cited by examiner

LABELLING MACHINE

This invention relates to a labelling machine of the type with a rotating carrousel, in particular of the type usable for applying a label on an article in a precise position relative to a notch or other reference element on the surface of the self-same article.

In general, the labelling machines for which this invention is intended comprise a supporting frame on which a carrousel is mounted in such a way that it can rotate about a vertical axis of rotation. The periphery of the carrousel is equipped with a plurality of supporting elements, for example rotating plates, for the articles to be labelled. The supporting elements are in turn able to rotate relative to the carrousel.

The machine also comprises motor devices designed to move the carrousel relative to the supporting frame and to move the supporting elements relative to the carrousel.

For feeding the articles to be labelled to the supporting elements and for subsequent removal of the labelled articles from the carrousel, there are a feed station and a pickup station (both usually constituted of a transfer starwheel coupled to an article feed track).

The machine also comprises at least one labelling device designed to supply a label to the articles positioned on the supporting elements which pass near to the labelling device during rotation of the carrousel.

In many applications the label must be placed in a precise position on the surface of the article, in such a way that the label is centred relative to other labels or other elements present on the article.

For this reason, the surface of the article has graphical elements, projections, notches or other marks which, once identified by a suitable detecting system, allow the machine to be provided with a reference for correctly positioning the label.

To identify the reference position on each article, some prior art machines use a plurality of optical detectors, each mounted on the carrousel close to a respective rotating plate. During machine operation, the article is made to rotate by the plate on which it is located and therefore the entire perimeter of the lateral surface of the article is scanned by the respective optical detector, thereby detecting said reference.

A first disadvantage of such prior art machines is the fact that they require an optical detector for each rotating plate and therefore, since a carrousel may usually have between ten and twenty plates (or more), the large number of optical detectors required has a considerable effect on the cost of the machine and its maintenance, as well as on construction complexity.

A second disadvantage of such prior art machines is the fact that, when the machine must be reconfigured to label articles of a second type or size which is different to a first type or size for which the machine is configured, all of the optical detectors must be substituted with others which are suitable for the second type or size of article and/or all of the optical detectors must be recalibrated for the second type or size. Therefore, the large number of optical detectors results in considerable costs for purchasing optical detectors which must be available for the various sizes. Moreover, the machine down time is long when a switch from one type of container to another type of container is necessary.

In other prior art labelling machines, for example the one described in German patent application number DE102005041497, in place of the optical detectors mounted on the carrousel, an image recording station is used, which is stationary relative to the carrousel supporting structure.

During the rotation of the carrousel, the articles on the rotating plates pass within the field of vision of video cameras belonging to the recording station.

To guarantee that the entire lateral surface of each article is scanned by the recording station when the machine operates at its usual operating speeds, the recording station must comprise at least three video cameras. That involves high costs for purchasing the recording station and considerable dimensions due to the latter. Moreover, to determine the position of the reference, it is necessary a combined processing of the images of at least three video cameras, with consequent operating complexity. Finally, the maximum number of articles per hour which the machine can process is significantly limited by the need for each article to perform a complete 360 degree rotation during the period in which it passes within the field of vision of the recording station.

A further prior art labelling machine is described in the international application publication No. WO2012090093, according to which the optical detectors are not fixed to the carrousel and are not stationary. In fact, this machine has optical detectors which are movable relative to the supporting structure and follow the carrousel for a limited stretch of the path of the articles. The detectors are mounted on a looped chain which is moved by a motor and which makes the detectors move along a looped path. This further machine, although having several advantages compared with the prior art machines described above, still requires the use of at least four detectors, since only half of them are located on an operating side of the looped path, the other half being inactive on the non-operating size. In fact, each detector must run along the angular extent of the carrousel that is necessary for detecting, then it must go back.

Moreover, said further machine is complex from a construction viewpoint, requiring a motor-driven system for moving the detectors, and must have a precise control system for guaranteeing synchronisation of the system which drives the detectors and the system which drives the carrousel and the rotating plates.

All of that having been said, the technical purpose which forms the basis of this invention is to provide a labelling machine which overcomes the above-mentioned disadvantages or which at least allows further advantages.

In one embodiment, the labelling machine according to this invention is designed to scan the lateral surface of each article to be labelled, so as to detect a reference element on the lateral surface and to allow correct positioning of a label by a labelling device.

In this context, in particular, the technical purpose of this invention is to provide a labelling machine which allows size change-overs to be performed faster than on prior art machines, allowing a reduction in the machine down time before production can be continued.

It is also the technical purpose of this invention to provide a labelling machine which can be made at a lower cost and is simpler to manage than the prior art machines.

In another embodiment, the principles behind this invention are used to provide a labelling machine provided with one or more print heads and which is designed to print a graphical image directly on the surface of the article or on a label already applied on the latter. In other words, the labelling device is or comprises the one or more print heads.

In this context, in particular, the technical purpose of this invention is to provide a labelling machine which is more versatile than the prior art machines.

The technical purposes specified and the aims indicated are substantially achieved by a labelling machine as described in the appended claims.

Basically, the principles behind this invention can be used to achieve correct and precise labelling and/or to carry out other operations which may be required on the article or container, in particular where a controlled and repeated positioning of the article is needed.

That is done by positioning an operating unit (whether this is a detecting sensor, a print head or another unit, depending on requirements) on a rotary support, which is mounted on the machine frame in such a way that its axis of rotation is at a distance, along a radial line, from the axis of rotation of the carrousel and the carrousel is movable relative to the axis of rotation of the rotary support and of the operating unit.

The rotation of the rotary support is coordinated with the rotation of the carrousel to keep the operating unit directed towards an article positioned on a respective rotating supporting element, mounted on the carrousel, along a stretch of angular movement of the carrousel. In other words, the operating unit follows the article, performing a rotation through a certain angle, in particular in a direction which is opposite to the direction of rotation of the rotating supporting element. Thanks to that following motion, the rotation of the operating unit is added to the rotation of the article, with a gain in terms of mutual angular speed between the operating unit and the article.

This, as well as simplifying the labelling machine and its operation, allows the use of few operating units, for example between one and four, depending on the machine production speed. A small number of operating units is advantageous because it allows the cost of the machine to be limited and reduces the time needed for maintenance and size changeovers.

Further features and the advantages of this invention are more apparent in the detailed description of several preferred, non-limiting embodiments of a labelling machine according to this invention. Said embodiments are illustrated in the accompanying drawings, in which.

Figure 1:
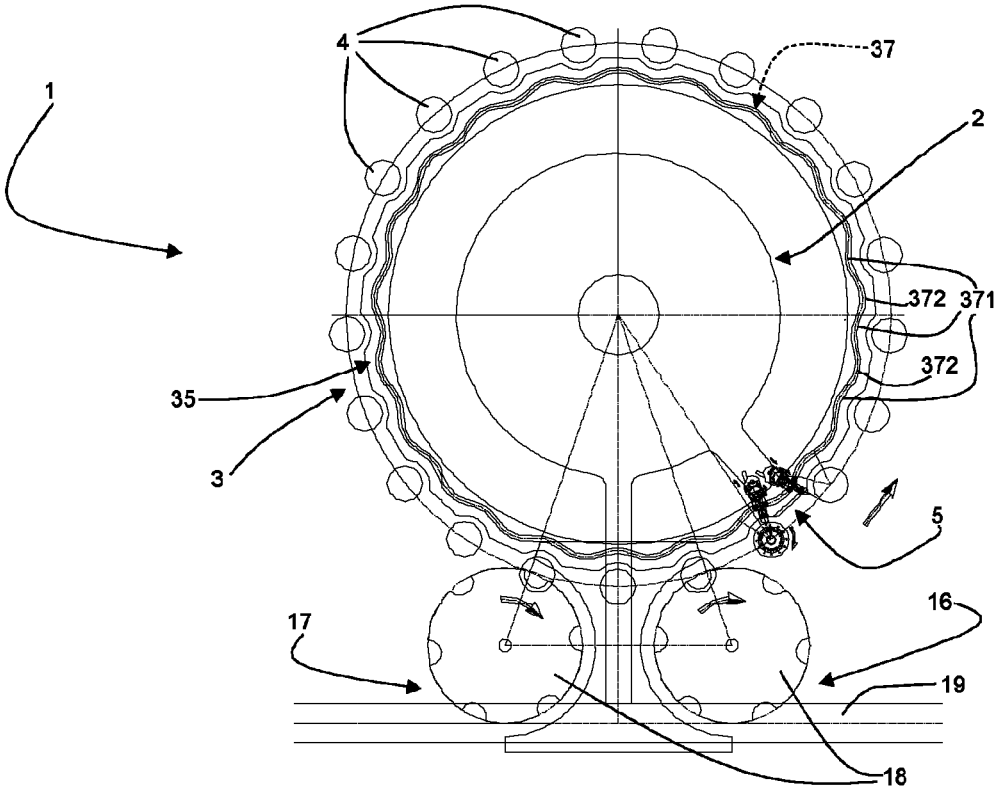
FIG. 1 is a schematic top view of a first embodiment of a labelling machine according to this invention.
Figure 2:
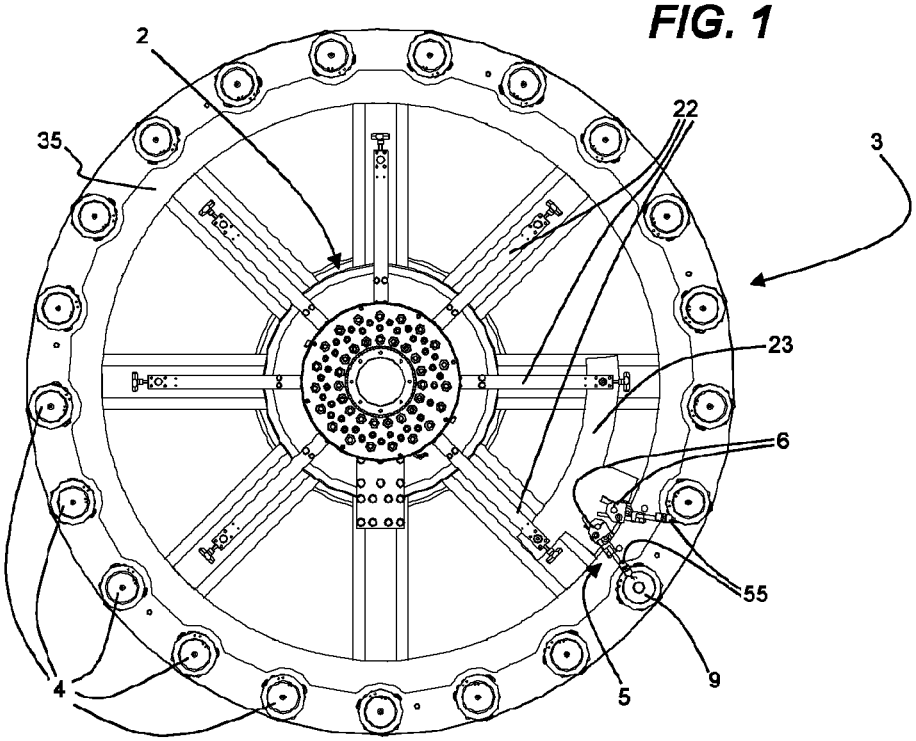
FIG. 2 is a top view of a carrousel which is part of the machine of FIG. 1.
Figure 3:
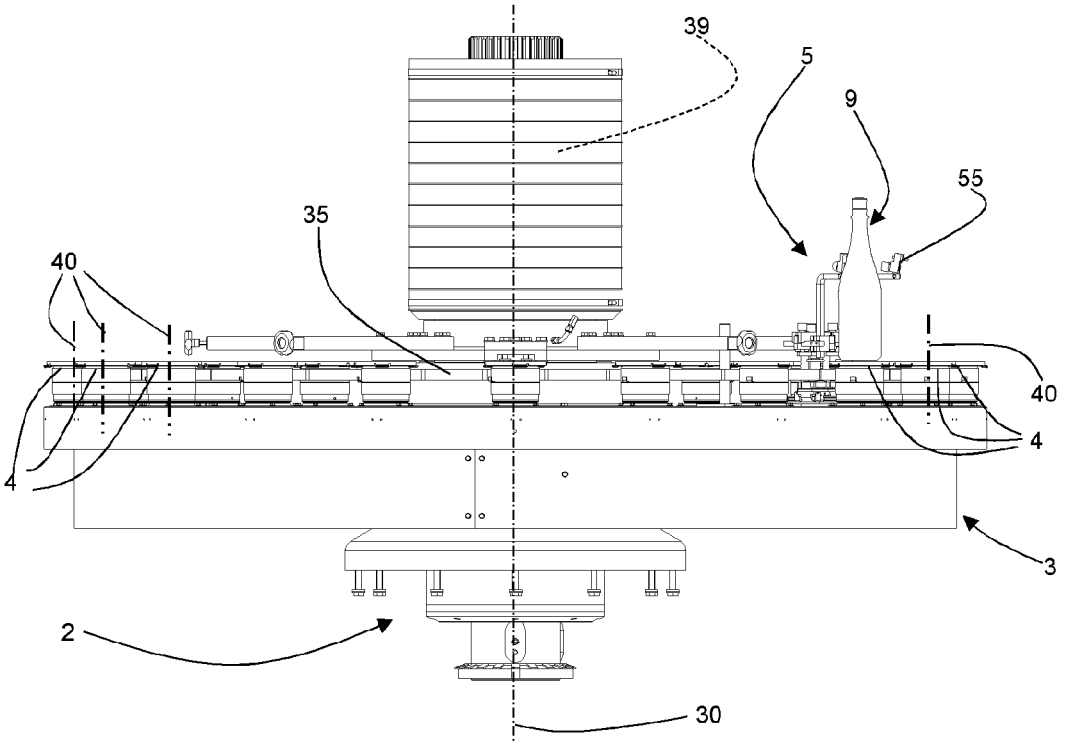
FIGS. 3 and 4 are two side views of the carrousel of FIG. 2.
Figure 4:
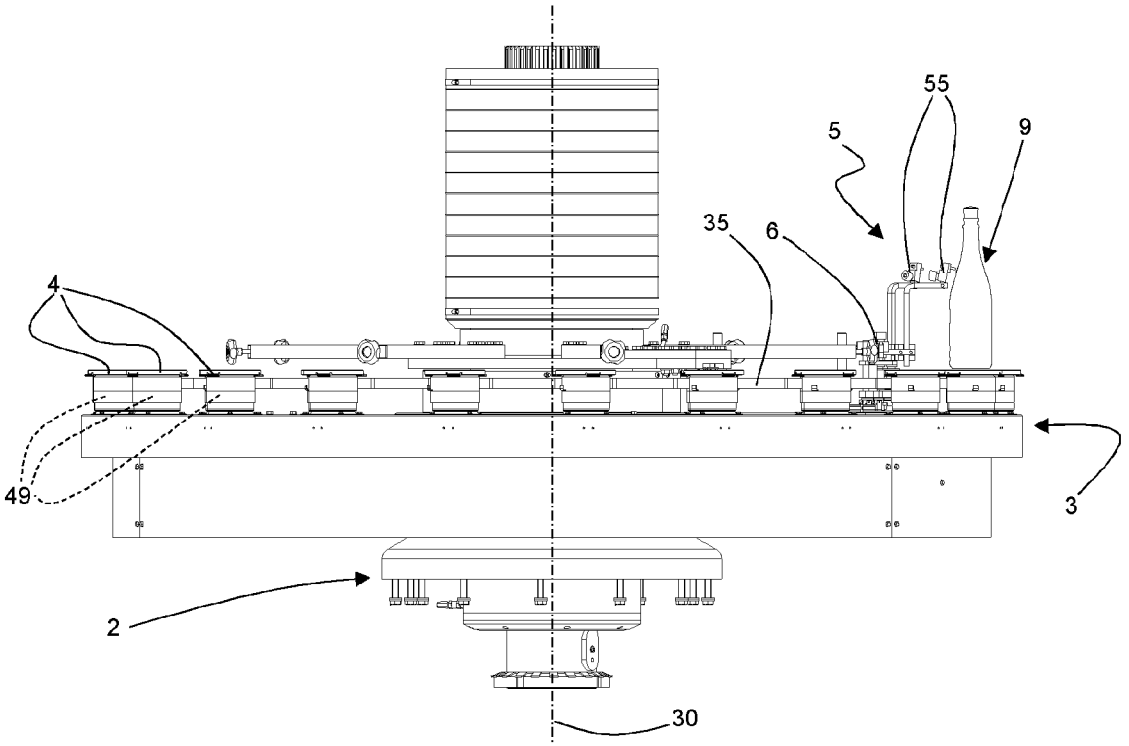
Figure 5:
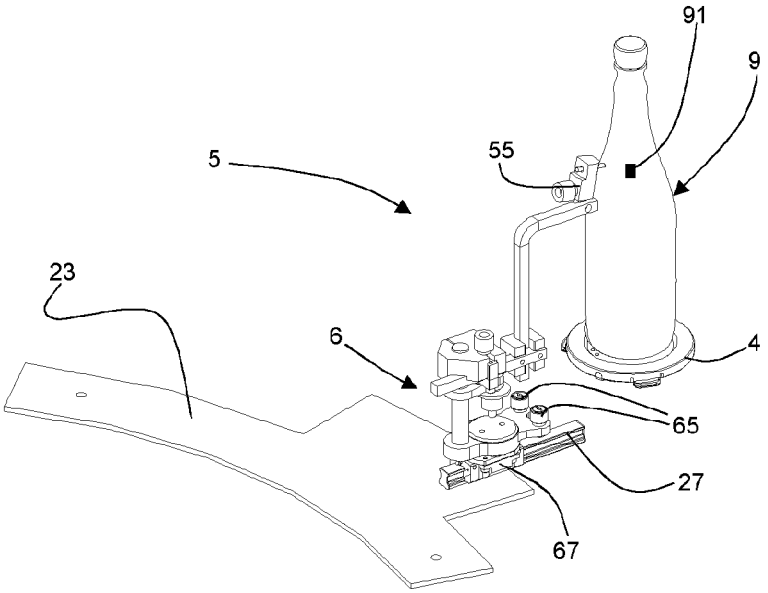
FIGS. 5 to 8 are respectively an axonometric view, a side view, a top view and a radial view of several components isolated from the rest of the machine of FIG. 1, in association with a bottle.
Figure 6:
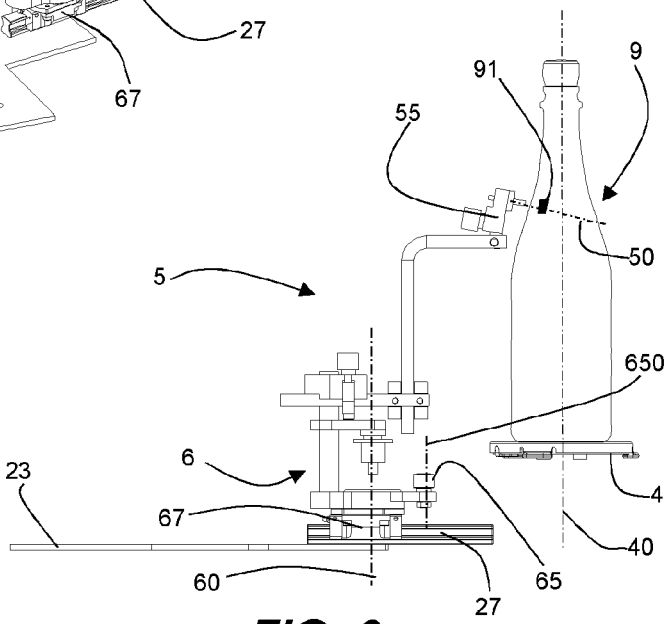
Figure 7:
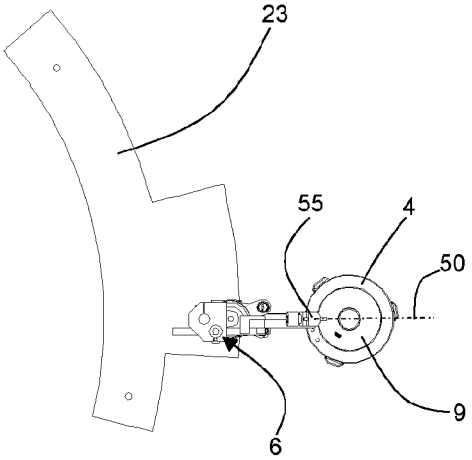
Figure 8:
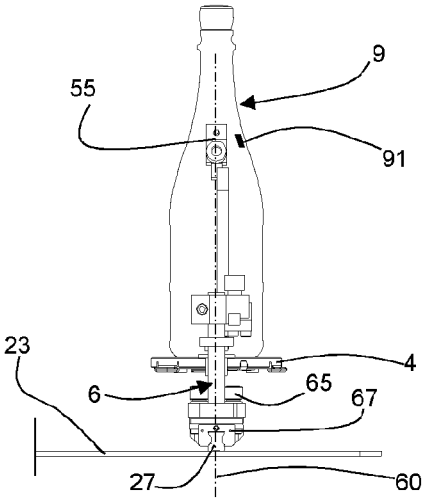
Figure 9:
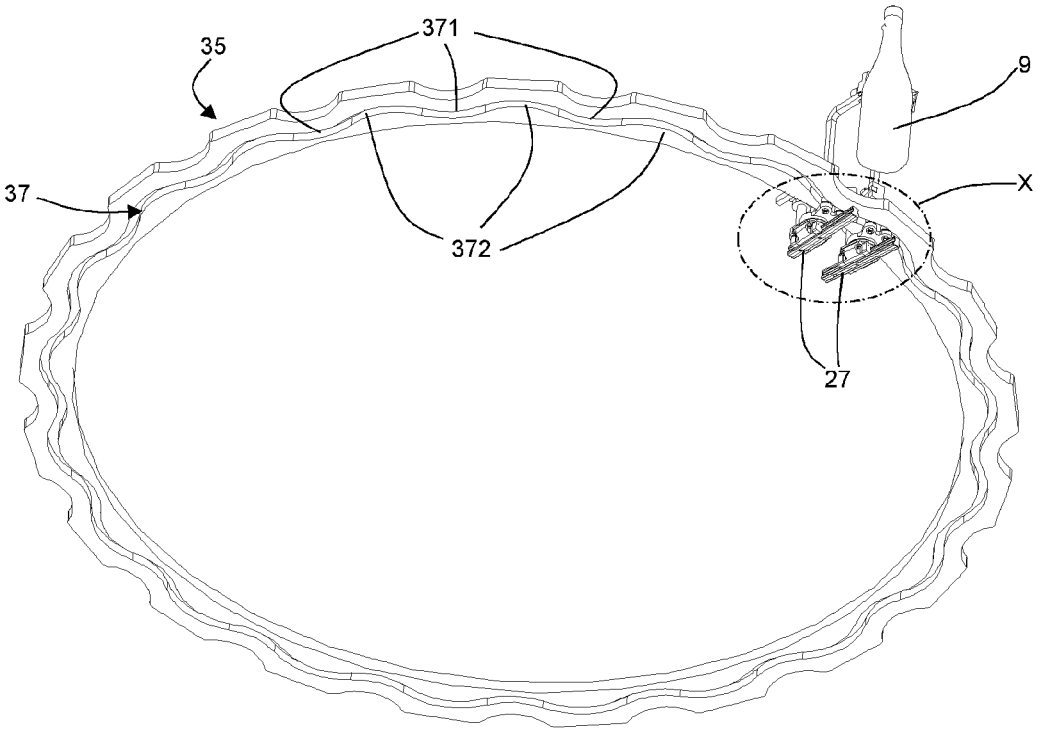
FIG. 9 is a bottom view of several components isolated from the rest of the machine of FIG. 1, in association with a bottle.
Figure 10:
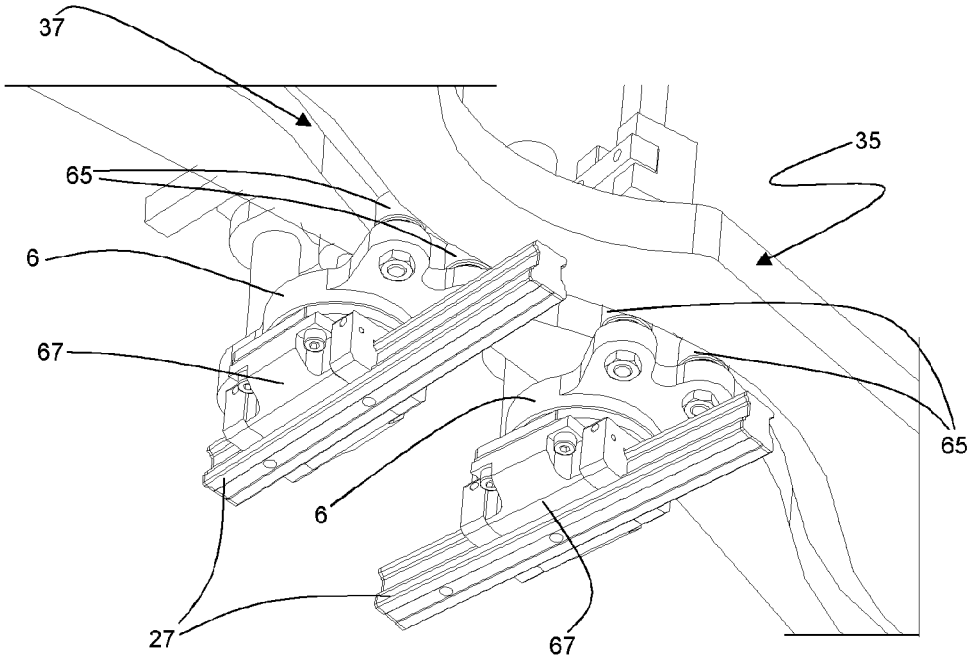
FIG. 10 is an enlarged view of the detail X of FIG. 9.

With reference initially to FIGS. 1 to 16, the numeral 1 denotes in its entirety a first embodiment of a labelling machine made in accordance with this invention.

Similarly to prior art machines, the labelling machine 1 comprises a supporting frame 2 and a carrousel 3, or head section, which is rotatably mounted on the supporting frame 2, in such a way that it can rotate about a first axis of rotation 30 which is substantially vertical. The periphery of the carrousel 3 is equipped with a plurality of supporting elements 4 for articles to be labelled. In particular, this detailed description refers to articles which are bottles 9. However, it shall be understood that said articles to be labelled may be containers of another type or other articles in general, preferably but not exclusively with a cylindrical lateral surface.

The carrousel 3 has a crown-shaped peripheral ring, in which the supporting elements 4 are located, which specifically are plates rotating about their own vertical central axes 40, which are parallel to the first axis of rotation 30. Essentially, each supporting element 4 is mounted on the periphery of the carrousel 3 and is able to rotate relative to the carrousel 3 about a respective second axis of rotation 40. The movement of each supporting element 4 (and of the bottle 9 on it) relative to the supporting frame 2 is therefore a combined movement, composed of the rotation of the carrousel 3 about the first axis of rotation 30 and of the rotation of the supporting element 4 about its second axis of rotation 40.

In the embodiment illustrated, the machine 1 comprises twenty one supporting elements 4, hereinafter referred to as rotating plates. For example, the carrousel 3 has a diameter of 1680 mm.

The movement (that is to say, the rotation) of the carrousel 3 relative to the frame 2 and that of the rotating plates 4 relative to the carrousel 3 is driven by one or more motor devices, in particular a motor 39 for the carrousel 3 and a plurality of motors 49, each for a respective rotating plate 4. Moreover, the movements of the carrousel 3 and of the rotating plates 4 are advantageously synchronised. In particular, that is achieved using electronically-controlled motors 39, 49 and an "electronic cam", that is to say, synchronised electronic control of the individual motors. Suitable encoders, connected to a processing and control unit, detect the angular movements of the carrousel 3 and of the rotating plates 4 about the respective axes of rotation 30, 40 as time passes during machine 1 operation The labelling machine 1 also comprises a feed station 16 for feeding the bottles 9 (to be labelled) to the rotating plates 4 and a pickup station 17 for picking up the bottles 9 (labelled) from the rotating plates 4. Both stations 16, 17 are substantially of the known type and are schematically illustrated in FIG. 1. Specifically, each station 16, 17 comprises a respective transfer starwheel 18 which is interposed between the carrousel 3 and a feed track 19 for the bottles to be labelled or which have been labelled. If necessary, the feed station 16 may comprise a screw feeder (not illustrated) for spacing the bottles with a correct step to allow them to be picked up by the transfer starwheel 18.

The labelling machine 1 comprises at least one labelling device (not illustrated in the figures) which, as in prior art labelling machines, is positioned radially along the periphery of the carrousel 3 for, in use, applying labels to the bottles 9 placed on the rotating plates 4 which pass near to it during rotation of the carrousel 3.

The figures only show one bottle 9, by way of example. However, it shall be understood that when the machine 1 is operating, all of the supporting elements 4 support respective bottles 9 which are progressively labelled.

To allow correct positioning of the label on the bottle 9, the labelling machine 1 also comprises a detecting station 5 which is designed to detect a reference element on the lateral surface of the bottle 9. In the figures, that reference element is a graphical mark 91 located on a capsule (or on a label) already positioned on the bottle 9. For example, the bottle 9 is a bottle for sparkling wine and the reference element 91 is a "spot" at the base of a typical capsule for that type of bottles.

Alternatively, the reference element may be a projection, a notch, a moulding mark deriving from bottle moulding or any other element which can be recognised by the detecting station 5 during a scan of the lateral surface of the bottle 9.

The detecting station 5 is positioned between the feed station 16 and the labelling device.

According to one aspect of this invention, the detecting station 5 comprises at least one support 6, which is mounted on the supporting frame 2 and is able to rotate about a third axis of rotation 60, and a detecting sensor 55 which is mounted on the rotary support 6.

The third axis of rotation 60 is at a distance, along a radial line, from the first axis of rotation 30 and, in particular, is parallel with the first axis of rotation 30 and with the second axes of rotation 40. Specifically, all of said axes are substantially vertical.

The detecting sensor 55 is designed to scan the lateral surface of the bottle 9 to detect the reference element 91. The sensor 55 has a detecting line, or operating line, which is essentially a central axis 50 of its field of vision. The sensor 55 is designed to carry out said scanning operation on an article 9 which is located on the detecting line 50.

Specifically, the sensor 55 is removably mounted, to allow substitution of the sensor 55 when a size change-over is carried out.

In the embodiment illustrated, the detecting sensor 55 is or comprises an optical fibre. Alternatively, the detecting sensor may be or comprise a photocell, a video camera or another system designed to detect the reference element 91. The labelling machine 1 also comprises a processing unit (not illustrated) which is operatively connected to the detecting sensor 55. During use, the processing unit saves and processes the information detected by the detecting sensor 55 and, based on that, identifies the angular position of the reference element 91, thereby determining the angular position of the bottle 9 and allowing precise labelling in the desired position.

For greater clarity, it must be specified that said angular positions shall be understood to be angles having the vertex on the axis of rotation 40 of the respective plate 4, in plan view, with the zero angle for example corresponding to alignment of the reference element 91 with the radial line which, coming out of the first axis of rotation 30 of the carrousel, intersects the same axis of rotation 40 of the plate. The rotary support 6 is constrained to a region of the supporting frame 2, in particular it is mounted on a plate 23 which is fixed to the main body (or central flange) of the supporting frame 2 and is close to the inner edge of the peripheral ring of the carrousel 3. Therefore, the rotary support 6 is positioned inside the carrousel 3, that is to say, its third axis of rotation 60 is located between the first axis of rotation 30 and the annular periphery of the carrousel 3.

Specifically, the supporting frame 2 comprises a plurality of arms 22 extending radially relative to the first axis of rotation 30 of the carrousel 3. The plate 23 is fixed to two such arms 22. Depending on requirements, it may be fixed to another two arms 22 selected depending on the angular position in which the detecting station 5 must be positioned.

Therefore, the rotary support 6 is mounted in such a way that its axis of rotation 60 is at a distance, along a radial line, from the first axis of rotation 30 of the carrousel 3. Moreover, as is explained in more detail below, the mounting is such that the positioning region of the rotary support 6 is substantially stationary relative to the supporting frame 2, except for a limited degree of radial sliding and the rotation of the rotary support 6 about its axis 60. In other words, whilst the carrousel 3 rotates about the first axis of rotation 30, the detecting station 5 does not rotate relative to said first axis 30 and remains in the same angular position relative to it. The detecting sensor 55, which is mounted on the rotary support 6 and therefore is rotatable together with it, is facing towards the peripheral ring of the carrousel 3. During operation of the labelling machine 1, the carrousel 3 rotates and therefore is movable relative to the third axis of rotation 60 and relative to the detecting sensor 55. All of the rotating plates 4 and the bottles 9 on them pass near to the detecting sensor 55.

As it passes near to the detecting sensor 55, each bottle 9 shows the detecting sensor 55 an angular range of its own lateral surface. Said angular range is directly proportional to the speed of rotation of the rotating plates 4 rotating about their second axis of rotation 40 and is in inverse proportion to the speed of rotation of the carrousel 3 about the first axis 30.

Moreover, the rotation of the rotary support 6 about the third axis 60 is coordinated with the rotation of the carrousel 3 about the first axis 30, thereby keeping the detecting sensor 55 directed with its detecting line 50 towards the bottle 9 on the rotating plate 4 in transit for a stretch of the angular movement of the carrousel 3 about the first axis 30.

In other words, thanks to the rotation of the rotary support 6 the detecting sensor 55 follows the bottle 9 (which in the meantime also rotates at a constant angular speed about the axis 40 of the plate 4) remaining substantially directed towards the centre of the bottle (that is to say, towards the axis of rotation 40 of the plate 4) for a longer time than in the prior art technical solutions with a stationary sensor.

That is useful to increase the angular range of the lateral surface of the bottle 9 which can be scanned by the detecting sensor 55, the other operating parameters of the machine 1 being equal.

It should be noticed that the expression "substantially directed towards the centre of the bottle" means that the detecting line 50 of the sensor 55 could deviate slightly from the precise centre of the bottle. In fact, adjustment of the sensor 55 could require a certain angle of inclination horizontally and/or vertically, even depending on the position and shape of the reference element 91 (which obviously must be able to pass within the field of vision of the sensor 55).

As already mentioned, in the embodiment illustrated in FIGS. 1 to 16 the rotary support 6 is positioned inside the carrousel 3. In this configuration, the carrousel 3 rotates about the first axis of rotation 30 with a first direction of rotation, whilst each rotating plate 4 rotates about the respective second axis of rotation 40 with a second direction of rotation which is opposite to the first direction of rotation. During the scan of the lateral surface of a bottle 9 by the detecting sensor 55, the rotary support 6 rotates about the third axis of rotation 60 with a third direction of rotation which is the same as the first direction of rotation and is opposite to the second direction of rotation.

That is useful for ensuring that the detecting sensor 55 remains pointing towards the bottle 9 for as long as possible, following it during the rotation of the carrousel 3, and also that the lateral surface of the bottle is shown to the sensor 55 with the greatest possible angular extent, thanks to the direction of rotation of the rotating plate 4 which maximises the tangential speed of the lateral surface shown to the sensor 55.

In the example illustrated, the first direction of rotation is anti-clockwise, the second direction of rotation is clockwise, the third direction of rotation is anti-clockwise during the operating step.

Specifically, the rotation of the rotary support 6 about the third axis of rotation 60 is an oscillating movement. The rotary support 6 performs an outward angular stroke in said third direction, during detection of the bottle 9 by the detecting sensor 55. At the end of detection of the bottle 9, the rotary support 6 performs a return angular stroke in the opposite direction, to prepare itself for detecting a bottle 9 on a subsequent rotating plate 4. That oscillating movement is useful for minimising the sensor 55 inactivity time. In fact, the sensor remains always substantially pointing towards the rotating plates 4 and the return stroke is short.

In the embodiment illustrated, coordination of rotation of the rotary support 6 and rotation of the carrousel 3 is achieved using a mechanical system, which has the advantage of being easy to make and not requiring any additional electronic control.

For this purpose, the machine 1 comprises an annular guide 35, or track, which is fixed to the carrousel 3 and is coaxial with the latter. The annular guide 35 has an undulating profile (or cam-shaped profile) extending in a ring shape. In particular, the annular guide 35 comprises a channel 37 (for example, made in a bottom face of the guide 35) with said undulating profile. In other words, the annular guide 35 has a groove 37 forming a closed path along the entire circumference of the annular guide 35. The closed path deviates from a circular shape and is instead undulating. In fact, it comprises a plurality of curved stretches 371, each having a concavity facing towards the axis of rotation 40 of a respective rotating plate 4, and a plurality of connecting stretches 372, also curved, interposed between said curved stretches 371.

Basically, at each rotating plate 4 there is a curved stretch 371 of the channel 37 or of the undulating profile. Said curved stretch 371 follows a perimetric stretch of the rotating plate 4 and, specifically, is an arc of a circle coaxial with the rotating plate 4, that is to say, having its centre on the second axis of rotation 40 of the rotating plate 4. Since the annular guide 35 is fixed to the carrousel 3 and therefore rotates with the latter about the first axis of rotation 30, said arrangement of the curved stretches 371 is maintained during operation of the machine 1.

The radius and angular extent of each curved stretch 371 are suitably calculated. Each connecting stretch 372 has a radius of curvature which depends on the angular pitch between the rotating plates 4 and is selected in such a way as to suitably connect the curved stretches 371 between which it is interposed. To optimise the movement of the rotary support 6, the connecting stretches 372 may be designed using the functions normally used to construct cams in channel for some types of prior art labelling machines.

In the embodiment shown in FIGS. 1 to 16, the annular guide 35 and its channel 37 are on the inside of the rotating plates 4. That is to say, in plan view, the channel 37 of the annular guide 35 is on the inside of the circle on which the rotating plates 4 are located. Therefore, the curved stretches 371 are concave relative to the outer profile of the carrousel 3, whilst the connecting stretches 372 are convex.

During rotation of the carrousel 3, the rotary support 6 operates in conjunction with the annular guide 35. The rotary support 6 has at least one follower member which follows the undulating profile of the annular guide 35 and which consequently causes a variation of the angular position of the rotary support 6 about its axis of rotation 60. Thanks to that, the oscillating movement of the rotary support 6 is determined by the follower member operating in conjunction with the annular guide 35.

Specifically, the follower member comprises two wheels 65 which are idly mounted on the rotary support 6, at a suitable radial distance from the respective third axis of rotation 60. The two wheels 65 can freely rotate about respective axes of rotation 650 which are parallel to the third axis of rotation 60. Moreover, the two wheels 65 are angularly spaced from each other relative to the third axis of rotation 60. The two idle wheels 65 are positioned in the channel 37, which has a transversal width slightly greater than the diameter of the wheels 65. Therefore, during rotation of the carrousel 3 and of the annular guide 35 the wheels 65 are in contact with the annular guide 35 and follow the undulating profile, forcing the rotary support 6 to oscillate about its third axis of rotation 60.

Moreover, the rotary support 6 can be moved within a predetermined limit relative to the supporting frame 2, that is to say, the third axis of rotation 60 can translate relative to the first axis of rotation 30, in particular along a substantially radial line. The translation of the third axis of rotation 60 is coordinated with the rotation of the carrousel 3 about the first axis of rotation 30, so that, during the detection, the distance between the sensor 55 and the second axis of rotation 40 of the supporting element 4 is kept constant along said stretch of angular movement of the carrousel 3 about the first axis of rotation 30. In other words, the movement of the rotary support 6 during the scan of the bottle 9 allows the sensor 55 to be kept at a constant distance from the lateral surface of the bottle 9, allowing optimum operation of the sensor.

In the embodiment illustrated, the rotary support 6 pivots at a slide 67, or carriage, which is slidably mounted on a linear guide 27 fixed to the supporting frame 2. Basically, the linear guide 27 is a track and is fixed to the plate 23. Specifically, the linear guide 27 extends along a line which is substantially radial relative to the first axis of rotation 30 of the carrousel 3.

During operation of the machine 1, the slide 67 slides on the linear guide 27 with a reciprocating movement, away from and towards the first axis of rotation 30 and the centre of the carrousel 3. Therefore, the third axis of rotation 60 of the rotary support 6 translates alternately away from and towards the first axis of rotation 30. That reciprocating movement is determined by the rotary support 6 operating in conjunction with the annular guide 35. The two wheels 65, moving in the channel 37, force both the rotary support 6 to rotate about the third axis of rotation 60, and the slide 67 to slide on the linear guide 27. In any case it should be noticed that the radial position of the slide 67 and the angular position of the rotary support 6 are univocally determined by the stretch of channel 37 in which the wheels 65 are located. Therefore, the movement of the detecting sensor 55 is determined by the shape of the profile of the annular guide 35 and is obtained with a purely mechanical system which does not require any additional motor or any electronic control.

In the embodiment illustrated, the detecting station 5 comprises two supports 6, each able to rotate about a respective third axis of rotation 60 and pivoting at a respective slide 67 which is slidably mounted on a respective linear guide 27 fixed to the supporting frame 2. The detecting station 5 also comprises two detecting sensors 55, each mounted on a respective rotary support 6. The two supports 6 are constrained to the supporting frame 2 in regions which are angularly spaced from each other relative to the first axis of rotation 30. In other words, the rotation of the carrousel 3 about its axis 30 makes each rotating plate 4 (and the respective bottle 9 on it) pass near to the detecting sensors 55 mounted on the supports 6, one after another.

Specifically, the two rotary supports 6 operate in conjunction with the same annular guide 35. The wheels 65 of the first rotary support and the wheels 65 of the second rotary support are positioned in successive stretches of the undulating profile of the annular guide 35. As is explained in more detail below, the rotary supports 6 perform oscillating movements which are out of phase from one another. The extent of the oscillation offset depends on the offset between the stretches of undulating profile in which the follower members of the rotary supports 6 are located.

The use of two (or more) rotary supports 6 is useful if the operating speed (in terms of bottles/minute) of the machine 1 is so high that a single sensor 55 would not be able to scan the entire angular extent (360 degrees) of the lateral surface of each bottle. In this case, the scan of the lateral surface is divided between the two detecting sensors 55, each of which detects a respective angular portion of the lateral surface.

In fact, the minimum number of rotary supports 6 and respective sensors 55 depends on the relationship between the maximum speed of rotation (in revolutions per minute) of the plates 4 and the production speed (in bottles per minute) of the machine 1, converting the production speed into steps per minute. The production speed is proportional to the speed of rotation of the carrousel and to the number of rotating plates.

A detecting station 5 with a single rotary support 6 and a single sensor 55 may be sufficient if the machine 1 has a low production speed, meaning that the time for which the bottle remains in the working field of the sensor 55 and its maximum speed of rotation are sufficient for a complete rotation of the bottle, that is to say, a rotation of at least 360 degrees.

Considering the maximum speed of rotation as a constant for the machine, a higher production speed would bring a reduction in the time for which the bottle remains in the working field of the sensor, requiring detection to be split into two or more portions (with a corresponding number of rotary supports and sensors) until completion of at least the 360 degrees necessary.

With reference to FIGS. 11 to 16, the following is a description of the scanning of the lateral surface of a bottle 9 on a rotating plate, labelled 4*a*. For a clearer explanation, the figures show a goniometer drawn on the rotating plate 4*a* of the bottle 9, centred on the axis of rotation 40 of the plate 4*a* and with the zero angle coinciding with the axis of the reference element 91 of the bottle 9.

During the operations described below, the carrousel 3 and the rotating plates 4 rotate at a constant speed about the respective axes.

Figure 11:
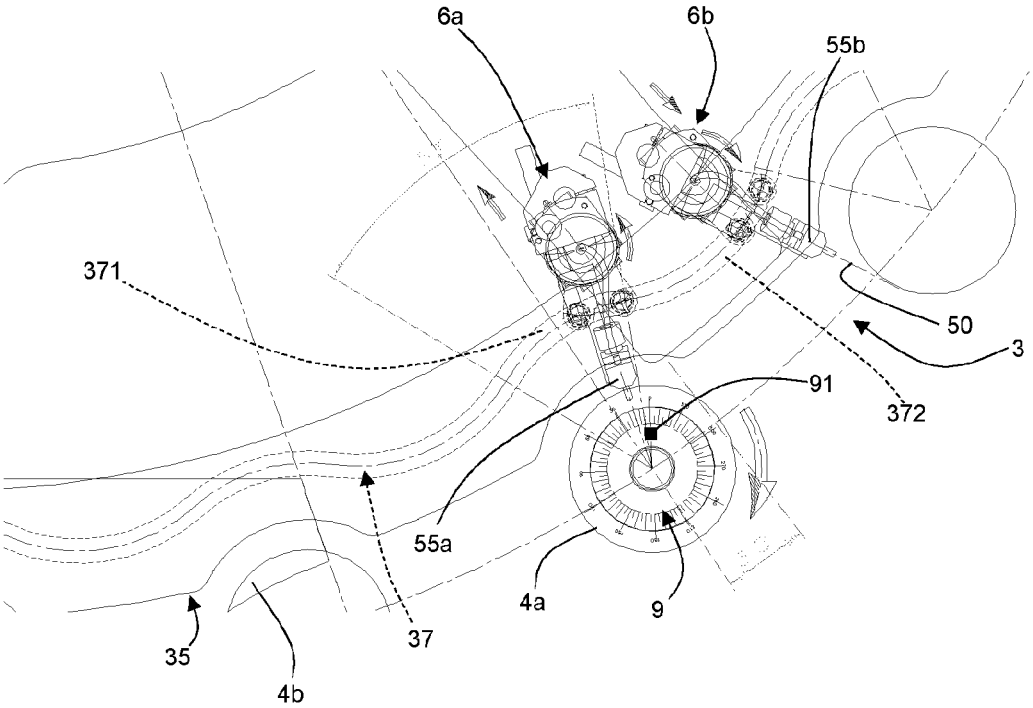
FIGS. 11 to 15 are schematic top views relative to an enlarged detail of the machine of FIG. 1, showing a sequence of positions during operation of the machine of FIG. 1, the position of FIG. 11 corresponding to the position of FIG. 1.

In FIG. 11, the bottle 9 on the rotating plate 4*a* enters a working field (or field of vision) for detection by the first sensor 55*a* which is mounted on the first rotary support 6*a*. The detecting line 50 of the sensor 55*a* is facing towards the bottle 9, which has random angular orientation. In particular, FIG. 11 shows the least favourable condition, in which the reference element 91 is just beyond the detecting line of the first sensor 55*a* (for example, the detecting line is at 15 degrees on the goniometer) and, therefore, the bottle 9 must rotate through a maximum angle to allow detection of the reference element 91.

Figure 12:
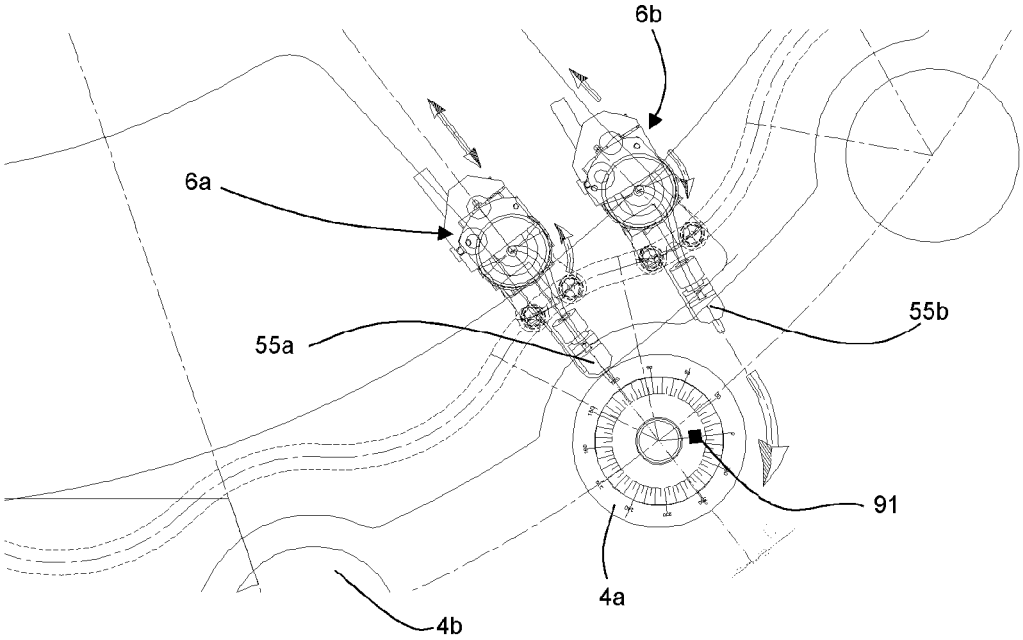

FIG. 12 shows the carrousel 3 after a rotation of 3.5 degrees about the first axis of rotation 30. Thanks to the interaction between the wheels 65 of the first rotary support 6*a* and the curved stretch 371 of the channel 37, the rotary support 6*a* has performed an anti-clockwise rotation relative to its axis 60. Consequently, the sensor 55*a* has kept its detecting line towards the centre of the bottle 9. The respective slide 67 has moved back on the linear guide 27 towards the centre of the carrousel 3, to follow the profile of the channel 37 for maintaining the distance between the sensor and the surface of the bottle. Moreover, the rotating plate 4*a* and the bottle 9 have performed a rotation about the respective axis 40, in a clockwise direction. The second rotary support 6*b* and the second sensor 55*b* have also performed respective movements. The bottle 9 has not yet entered the working field of the second sensor 55*b*.

Figure 13:
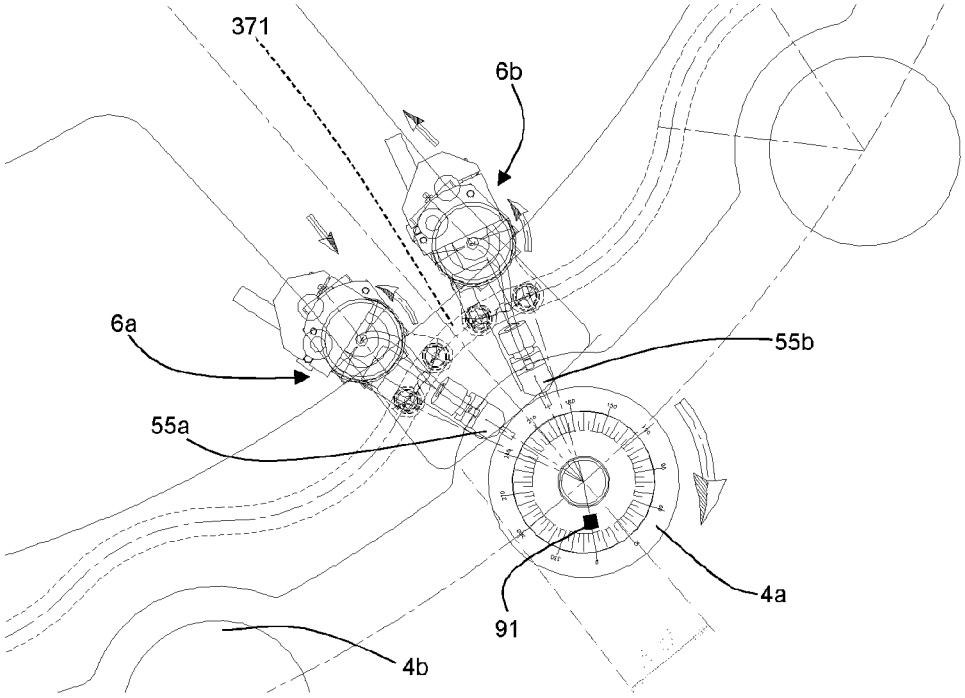

FIG. 13 shows the carrousel 3 after another rotation of 3.5 degrees about the first axis of rotation 30. The movements have continued in the directions indicated by the arrows. The slide 67 of the first rotary support 6*a* has moved towards the periphery of the carrousel 3, whilst the first sensor 55*a* remained pointing towards the centre of the bottle 9. The second rotary support 6*b* also engages the curved stretch 371 of the channel 37 and the bottle 9 has entered the working field of the second sensor 55*b*, whose detecting line points towards the centre of the bottle 9 (at 195 degrees on the goniometer) with the same angular position as the first sensor 55*a* in FIG. 11.

It should be noticed that, at this point, the detecting line of the first sensor 55*a* is at 225 degrees on the goniometer. Considering the initial start at 15 degrees, the first sensor 55*a* has scanned 210 degrees of lateral surface of the bottle 9 when the scan by the second sensor 55*b* starts. Therefore, in this part there is a 30 degree overlap between the end of the scan by the first sensor 55*a* and the start of the scan by the second sensor 55*b*.

Figure 14:
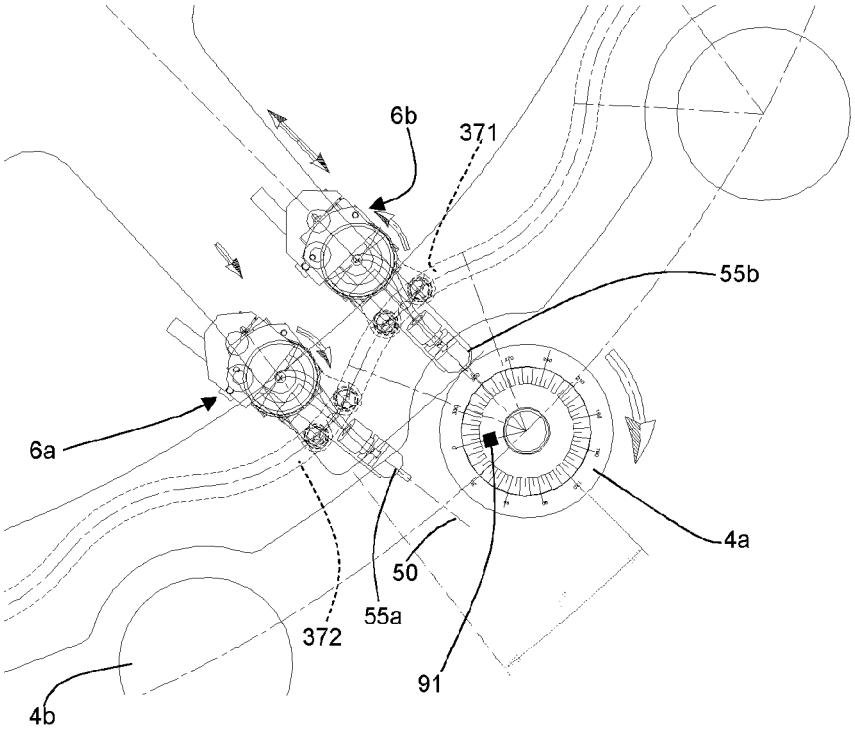

FIG. 14 shows the carrousel 3 after a further rotation of 3.5 degrees about the first axis of rotation 30. The second sensor 55*b* is repeating the movements already made by the first sensor 55*a* and continues the scan of the lateral surface, remaining pointing towards the centre of the bottle 9. Basically, in the embodiment illustrated, the second sensor 55*b* repeats the movements of the first sensor 55*a* with a phase delay of 7 degrees, measured on the rotation of the carrousel 3.

The bottle 9 has exited the working field of the first sensor 55*a*, whose rotary support 6*a* engages the convex connecting stretch 372 of the channel 37, rotating clockwise so as to reposition itself in the start scan position for the next plate 4*b*. In the embodiment illustrated, the amplitude of the oscillation of each rotary support 6*a*, 6*b* is 50 degrees. That is to say, the rotary support rotates with that angle about its axis of rotation 60 between the moment when the scan starts (when it starts being pointed towards the centre of the plate) and the moment when the scan ends (when it stops being pointed towards the centre of the plate).

Figure 15:
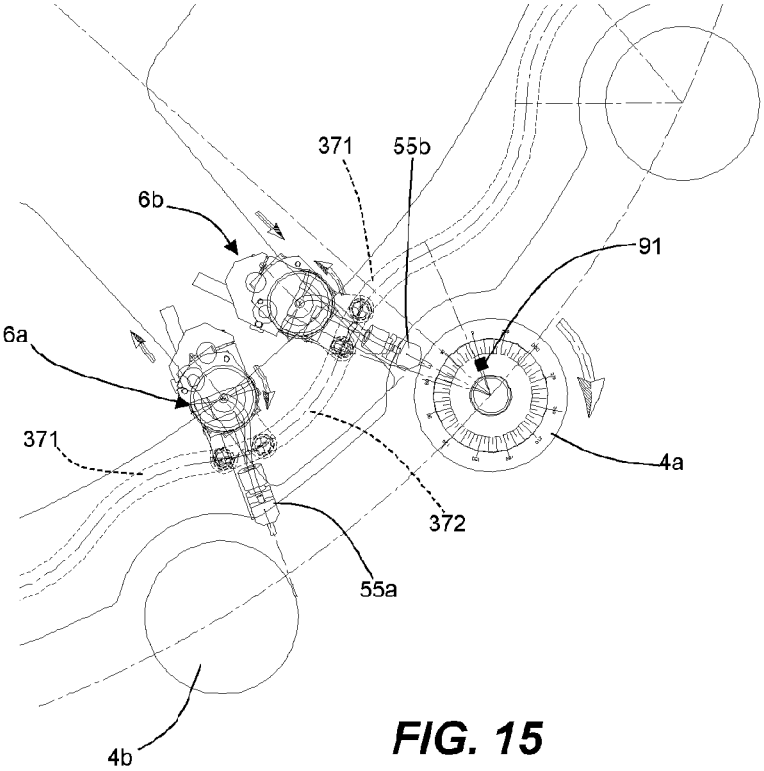
Figure 16:
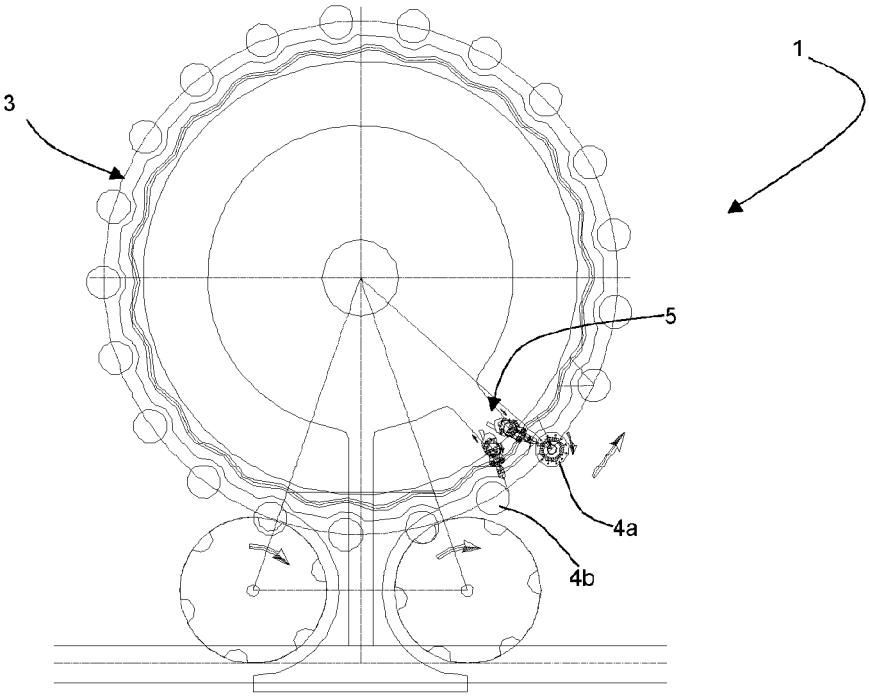
FIG. 16 is a schematic top view of the machine of FIG. 1, in the position of FIG. 15.
Figure 17:
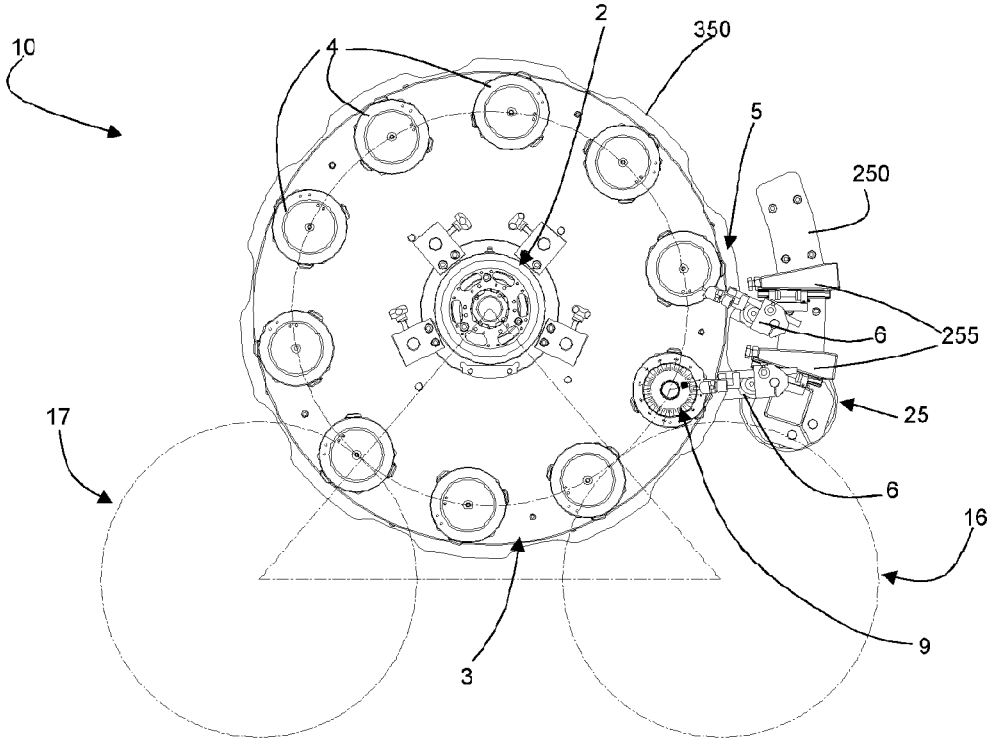
FIG. 17 is a schematic top view of a second embodiment of a labelling machine according to this invention.
Figure 18:
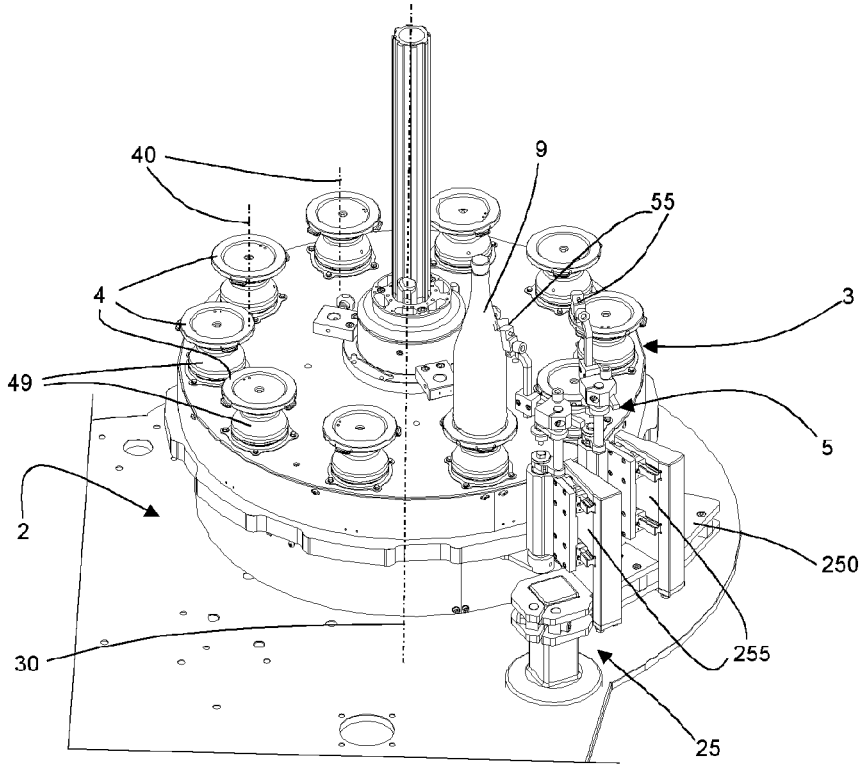
FIG. 18 is an axonometric view of the machine of FIG. 17, from which several parts have been removed.
Figure 19:
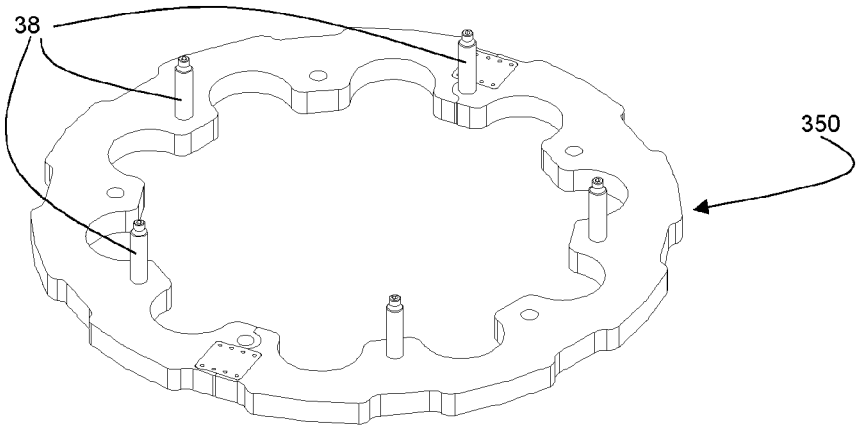
FIGS. 19 and 20 are respectively an axonometric top view and bottom view of a component of the machine of FIG. 17.
Figure 20:
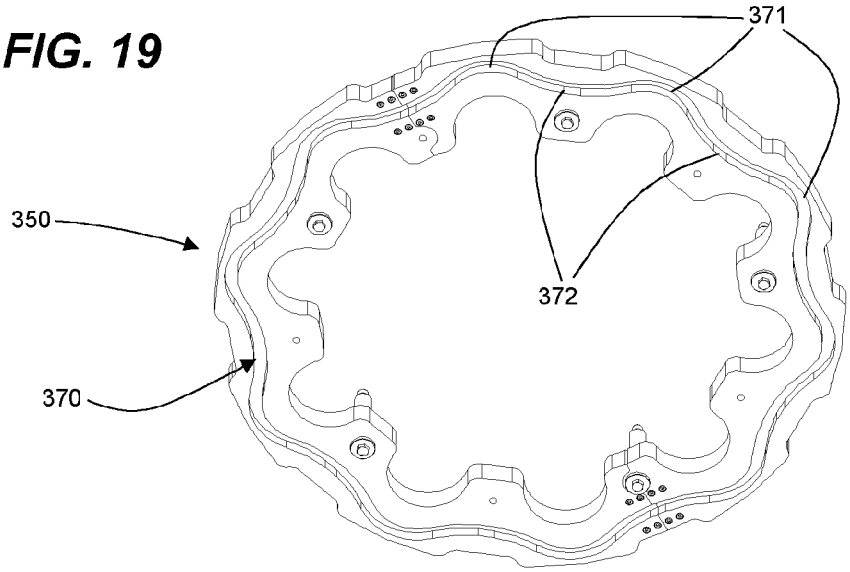
Figure 21:
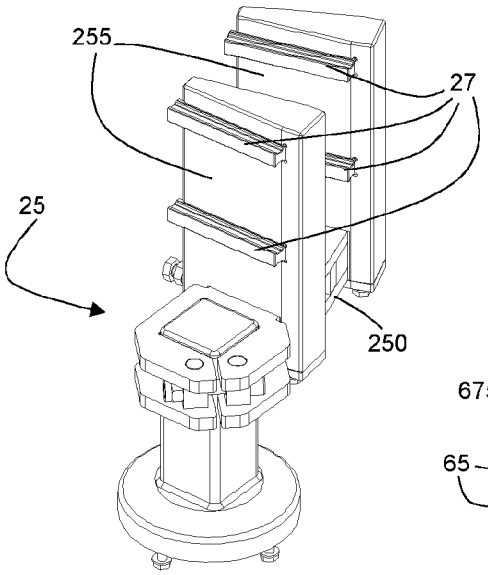
FIGS. 21 to 23 are axonometric views of three other components of the machine of FIG. 17.
Figure 22:
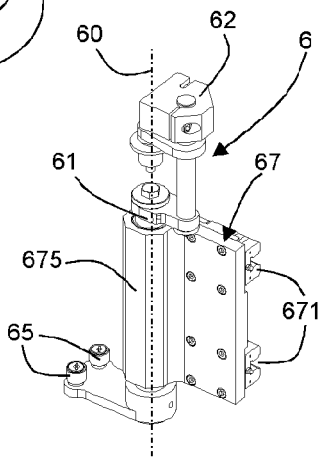
Figure 23:
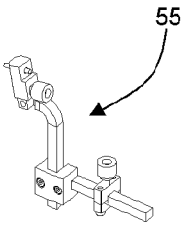

FIG. 15 shows the carrousel 3 after yet another rotation of 3.5 degrees about the first axis of rotation 30. The second sensor 55*b* is still pointing towards the centre of the bottle 9, even if the scan has been completed. In fact, the reference element 91 has crossed the detecting line of the second sensor 55*b* and gone beyond it by 47 degrees. The second sensor 55*b* has scanned 212 degrees of lateral surface, with a 32 degree overlap between the end of the scan by the second sensor 55*b* and the start of the scan by the first sensor 55*a*.

The second sensor 55*b* is entering the connecting stretch 372, whilst the first sensor 55*a* is entering the curved stretch 371 for the next plate 4*b*. Another 3.5 degree rotation of the carrousel 3 takes things back to the condition shown in FIG. 11, obviously with the next plate 4*b* in place of the plate 4*a*.

From the above it emerges that the entire lateral surface of the bottle 9 has been scanned by the combination of the two sensors 55*a*, 55*b*. This guarantees that, irrespective of the starting angular position of the bottle 9, the reference element 91 has been seen by at least one of the two sensors 55*a*, 55*b*. Moreover, the detections of the two sensors overlap by 30 degrees and 32 degrees. Those overlaps are safety margins to guarantee that the entire reference element 91 is seen by at least one of the two sensors, avoiding the risk that both sensors see only part of the reference element 91.

Basically, each sensor 55*a*, 55*b* operates on a respective portion of the lateral surface of the bottle 9. Those portions are angular stretches of the lateral surface, selected in such a way that together they cover more than 360 degrees, that is to say, they cover the entire circumference of the bottle. Moreover, the portions detected partly overlap one another.

Using a software, the processing unit assembles the sensor detections and obtains a single sequence of data for the 360 degrees of the lateral surface of the bottle, on which it identifies the reference element 91. That, combined with the data detected by the encoders, allows the bottles 9 on the plates 4 to be positioned correctly for the label application step, or for activating the labelling device at the correct moment.

In an alternative embodiment (not illustrated) each rotary support 6 operates in conjunction with a respective annular guide. That is to say, there are multiple annular guides, one for each rotary support, if necessary having channels which are different to one another.

In another alternative embodiment (not illustrated), the annular guide is not present and the coordinated movement of the rotary support 6 is implemented by two synchronised servomotors (one for the radial translation and one for the rotation), or by a rotating shaft in conjunction with a connecting rod.

With reference to FIGS. 17 to 30, the numeral 10 denotes in its entirety a second embodiment of a labelling machine made in accordance with this invention.

The labelling machine 10 is a variant of the labelling machine 1 described above. Therefore, only the significant differences compared with the labelling machine 1 are described in detail below. For all of the other details, reference should be made to the above description. Unless otherwise indicated, parts and elements having the same function in the machine 1 and in the machine 10 retain the same reference number. Moreover, the figures for the machine 10 do not show in detail the feed station 16, the pickup station 17, the feed track 19, the motor 39 and other components which are not essential for an understanding of the invention. However, it shall be understood that these aspects may be implemented in similar way to that described for the machine 1 or the prior art.

The biggest difference compared with the machine 1 is the fact that, in the labelling machine 10, the at least one rotary support 6 of the detecting station 5 is positioned outside the carrousel 3. Basically, the periphery of the carrousel 3 passes through a region between the first axis of rotation 30 and the third axis of rotation 60 of the rotary support 6.

This technical solution is useful particularly for carrousels 3 with a smaller diameter, in which the detecting station 5 would not fit inside the carrousel 3. In the embodiment illustrated, the machine 10 comprises ten rotating plates 4 and the carrousel 3 has a diameter of 600 mm.

The annular guide (labelled 350 here) and its channel (labelled 370 here) are outside the rotating plates 4. That is to say, in plan view, the channel 370 of the annular guide 350 is outside the circle on which the rotating plates 4 are located. Consequently, the curves of the undulating profile of the outer annular guide 350 are inverted compared with the inner annular guide 35. Specifically, the curved stretches 371, which follow a perimetric stretch of the respective rotating plates 4 and are circle arcs coaxial with the respective rotating plates 4, are convex relative to the outer perimeter of the annular guide 350, whilst the connecting stretches 372 are concave.

The annular guide 350 is fixed to the carrousel 3, with spacers 38 interposed between them. Therefore, the annular guide 350 and the carrousel 3 rotate together about the first axis of rotation 30.

In this configuration with rotary supports 6 positioned on the outside, the carrousel 3 rotates about the first axis of rotation 30 with a first direction of rotation and each rotating plate 4 rotates about the respective second axis of rotation 40 with a second direction of rotation which is the same as the first direction of rotation. During the scan of the lateral surface of a bottle 9 by the detecting sensor 55, the rotary support 6 rotates about the third axis of rotation 60 with a third direction of rotation which is opposite to the first direction of rotation and to the second direction of rotation.

In the example illustrated, the first direction of rotation and the second direction of rotation are anti-clockwise, whilst the third direction of rotation is clockwise during the operating step. It should be noticed that, as for the machine 1, the plate 4 (and therefore the bottle 9) and the rotary support 6 (and therefore the detecting sensor 55) rotate in opposite directions during the operating step.

The detecting station 5 of the machine 10 may also comprise one or more rotary supports 6, with relative sensors 55. In the embodiment illustrated, the machine 10 comprises two rotary supports 6 and two sensors 55.

The machine 10 comprises a bracket 25 which is securely fixed to the supporting structure 2. In particular it is mounted on a bench which also supports the carrousel 3. The bracket 25 comprises a shelf 250, having an arc shape which follows an arc of a circle centred on the first axis of rotation 30 of the carrousel 3. Two plates 255 extend from the shelf 250, vertically and along a line which is substantially radial relative to the first axis of rotation 30. Moreover, the two plates 255 are angularly spaced from each other relative to the first axis of rotation 30. The position of the plates 255 is adjustable along the arc of the shelf 250.

Each plate 255 supports a respective rotary support 6. In particular, each plate 255 is provided with at least one linear guide 27 (specifically, two linear guides 27 which are parallel to one another), on which a slide 67 is slidably mounted. The rotary support 6 pivots at said slide 67.

The slide 67 comprises respective counter-guides 671 which engage with the linear guides 27, allowing a sliding of the slide 67 relative to the bracket 25 along a line which is substantially radial. The slide 67 also comprises a tubular portion 675 extending vertically and housing a shaft 61 of the rotary support 6, thereby implementing the pivoting of the rotary support 6 at the slide 67 relative to an axis of rotation 60.

As for the machine 1, the rotary support 6 comprises idle wheels 65 which are positioned in the channel 370 for following its undulating profile, thereby causing the oscillating movement of the rotary support 6. Moreover, the rotary support 6 comprises a head 62 which is on the opposite side of the shaft 61 to the idle wheels 65. The detecting sensor 55 is removably fixed to the head 62.

Similarly to FIGS. 11 to 16, FIGS. 24 to 30 show the scanning of the lateral surface of a bottle 9 on a rotating plate 4*a* during operation of the labelling machine 10. The figures show a goniometer drawn on the rotating plate 4*a*, centred on the axis of rotation 40 of the plate 4*a* and with the zero angle coinciding with the axis of the reference element 91 of the bottle 9.

During the operations described below, the carrousel 3 and the rotating plates 4 rotate at a constant speed about the respective axes.

Figure 24:
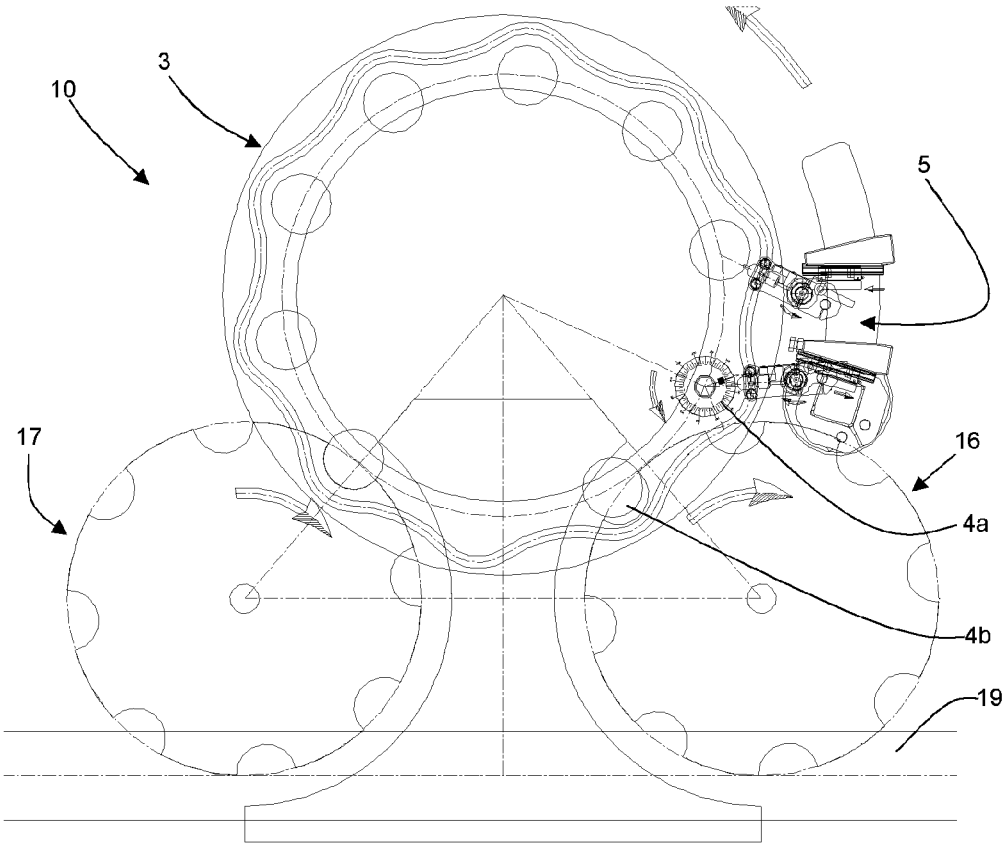
FIG. 24 is a schematic top view of the machine of FIG. 17, in an operating position.
Figure 25:
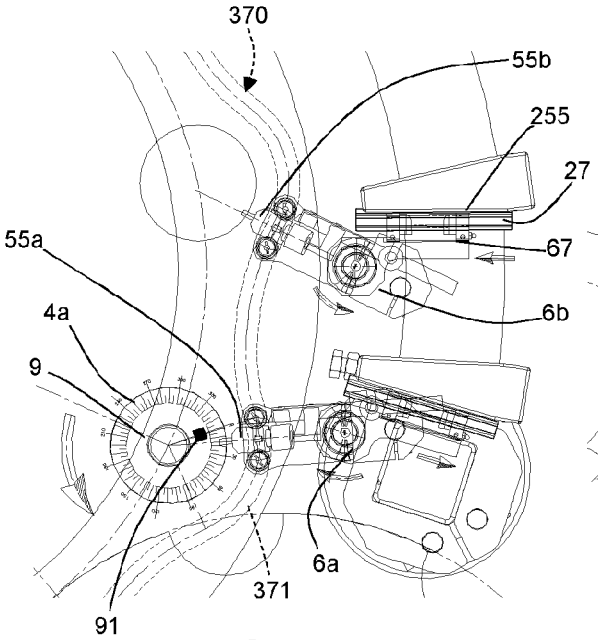
FIGS. 25 to 29 are schematic top views relative to an enlarged detail of the machine of FIG. 17, showing a sequence of positions during operation of the machine of FIG. 17, the position of FIG. 25 corresponding to the position of FIG. 24.

In FIGS. 24 and 25, the bottle 9 on the rotating plate 4*a* enters the working field of the first sensor 55*a* which is mounted on the first rotary support 6*a*. Detection begins. For example, the reference element 91 is just beyond the detecting line 50 of the first sensor 55*a*. The detecting line 50 is at 15 degrees on the goniometer.

Figure 26:
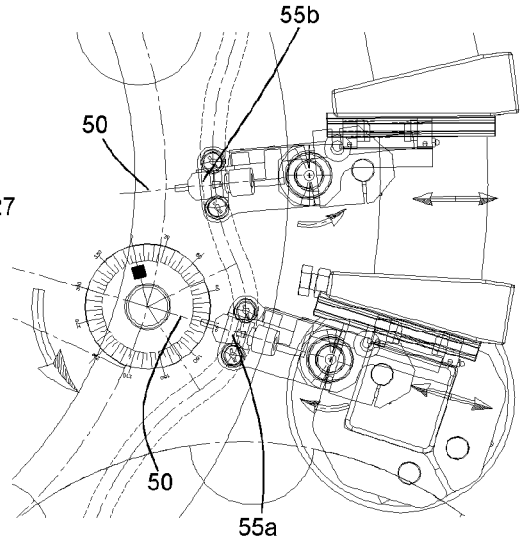

FIG. 26 shows the carrousel 3 after a rotation of 8.217 degrees about the first axis of rotation 30. Thanks to the interaction between the wheels 65 of the first rotary support 6*a* and the curved stretch 371 of the channel 370, the rotary support 6*a* has performed a clockwise rotation relative to its axis 60. The respective slide 67 has moved on the linear guides 27 away from the centre of the carrousel 3. The sensor 55*a* has kept its detecting line 50 pointing towards the centre of the bottle 9. The rotating plate 4*a* and the bottle 9 have performed a rotation about the respective axis 40, in an anti-clockwise direction. The second rotary support 6*b* and the second sensor 55*b* have also performed respective movements. The bottle 9 has not yet entered the working field of the second sensor 55*b*.

Figure 27:
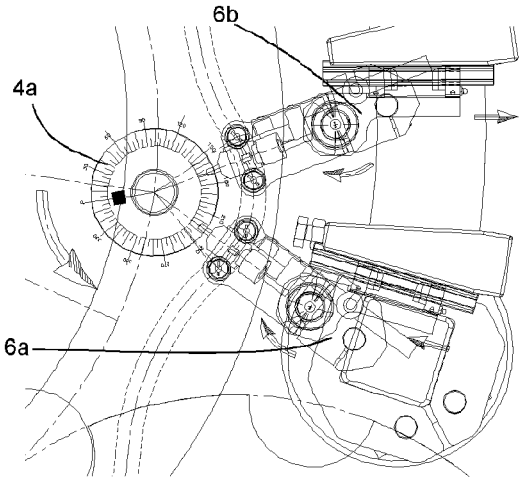

FIG. 27 shows the carrousel 3 after another rotation of 8.217 degrees about the first axis of rotation 30. The movements have continued in the directions indicated by the arrows. The slide 67 of the first rotary support 6*a* has moved on the linear guides 27 towards the centre of the carrousel 3. The first sensor 55*a* has remained pointing towards the centre of the bottle 9. The detecting line 50 of the first sensor 55*a* is at 225 degrees on the goniometer. The second rotary support 6*b* also engages the curved stretch 371 of the channel 370 and the bottle 9 has entered the working field of the second sensor 55*b*, which is pointing towards the centre of the bottle 9 (at 168 degrees on the goniometer) and begins detecting. Considering the initial start at 15 degrees, the first sensor 55*a* has scanned 210 degrees of lateral surface of the bottle 9 when the scan by the second sensor 55*b* starts. Therefore, in this part there is a 42 degree overlap between the scans of the two sensors.

Figure 28:
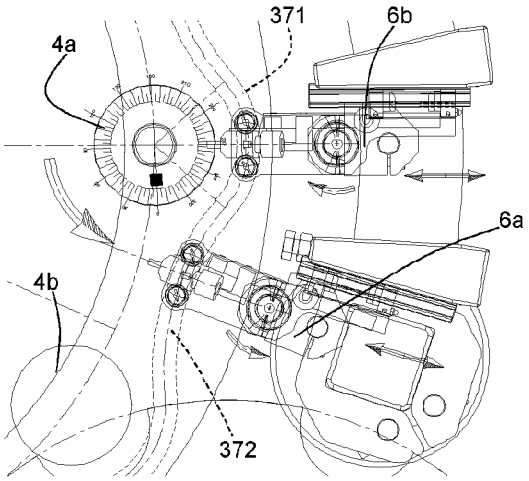

FIG. 28 shows the carrousel 3 after a further rotation of 8.217 degrees about the first axis of rotation 30. The second sensor 55*b* is repeating the movements already made by the first sensor 55*a* and continues the scan of the lateral surface, remaining pointing towards the centre of the bottle 9. The bottle 9 has exited the working field of up the first sensor 55*a*, whose rotary support 6*a* engages the convex connecting stretch 372 of the channel 370, rotating anti-clockwise so as to reposition itself in the start scan position for the next plate 4*b*. In the embodiment illustrated, the amplitude of the oscillation of each rotary support 6*a*, 6*b* is 84 degrees. That is to say, the rotary support rotates with that angle about its axis of rotation 60 between the moment when the scan starts (when it starts being pointed towards the centre of the plate) and the moment when the scan ends (when it stops being pointed towards the centre of the plate).

Figure 29:
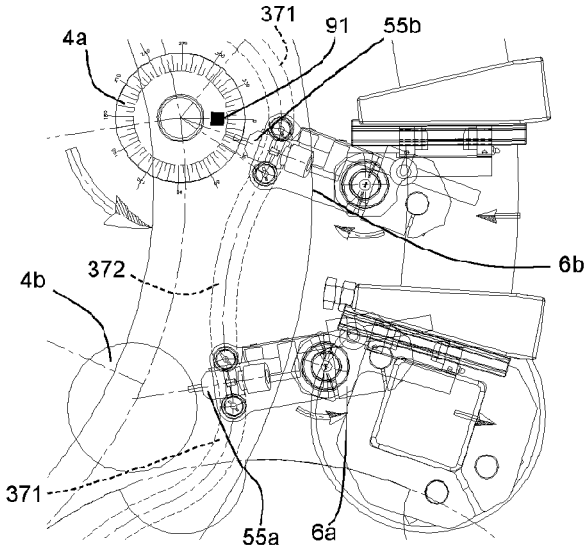
Figure 30:
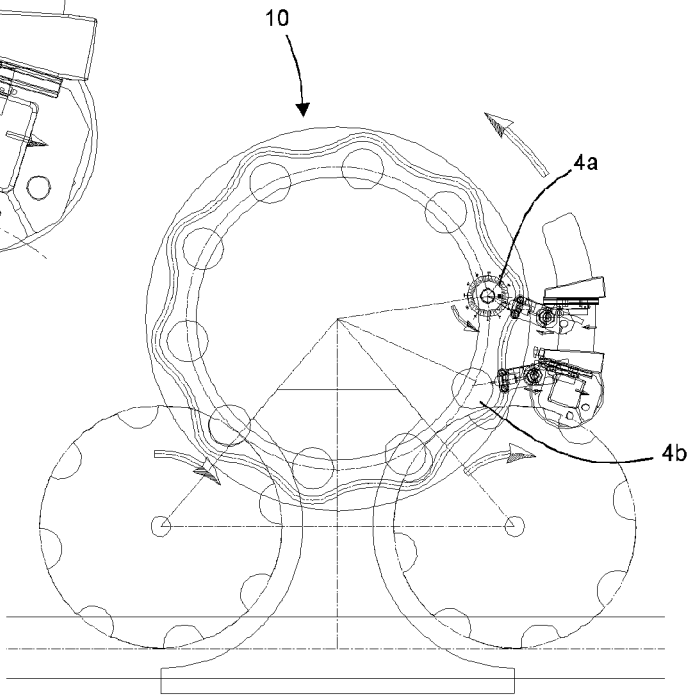
FIG. 30 is a schematic top view of the machine of FIG. 17, in the position of FIG. 29.
Figure 31:
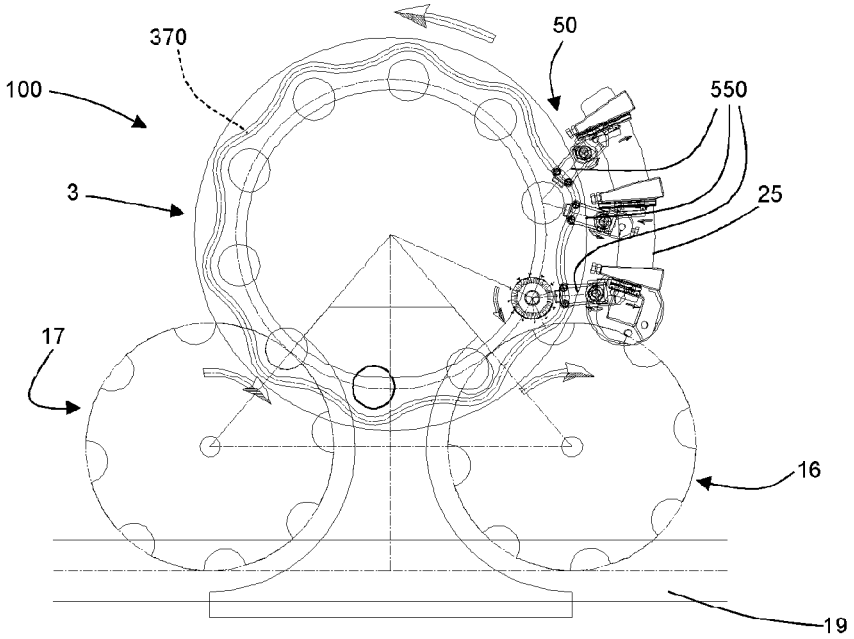
FIG. 31 is a schematic top view of a third embodiment of a labelling machine according to this invention.
Figure 32:
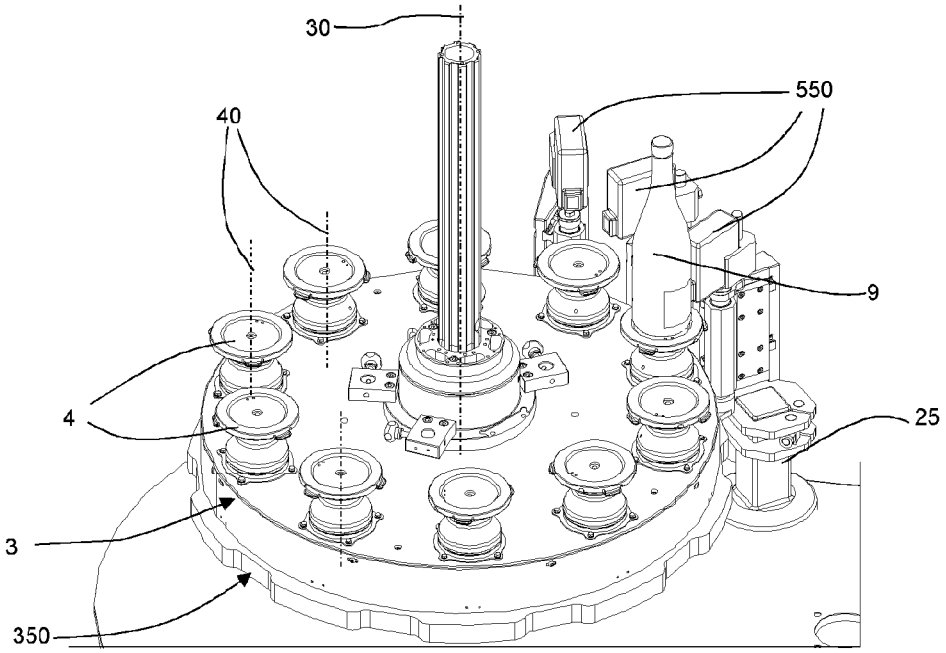
FIGS. 32 and 33 are axonometric views of the machine of FIG. 31, from which several parts have been removed.
Figure 33:
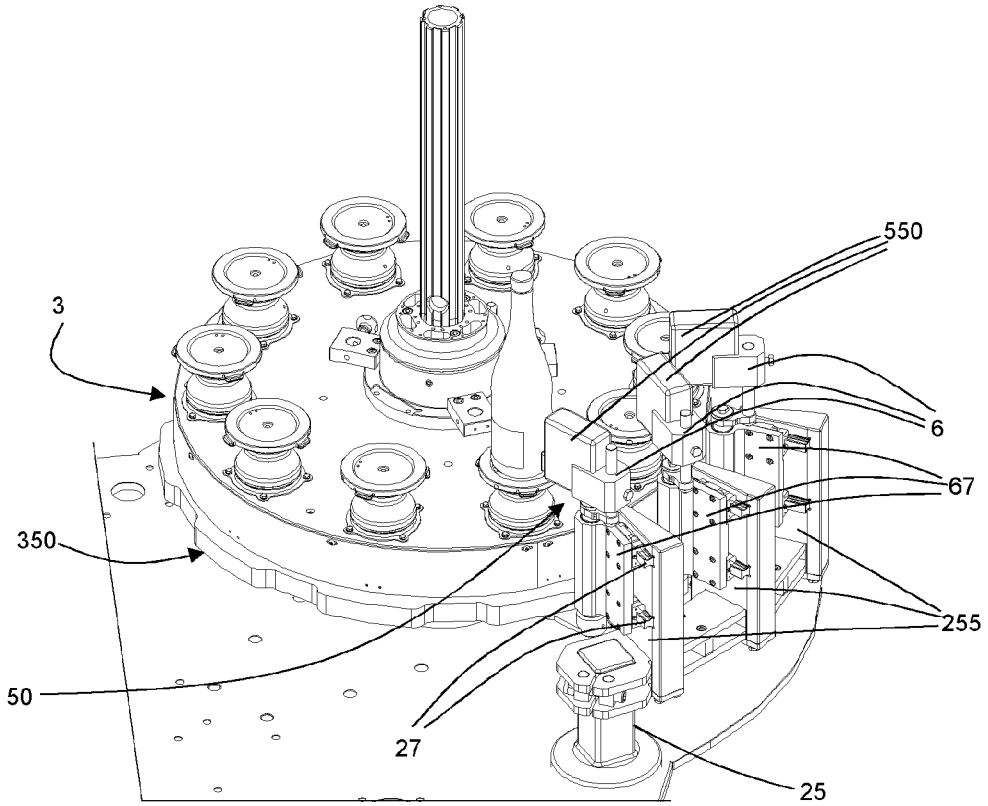
Figure 34:
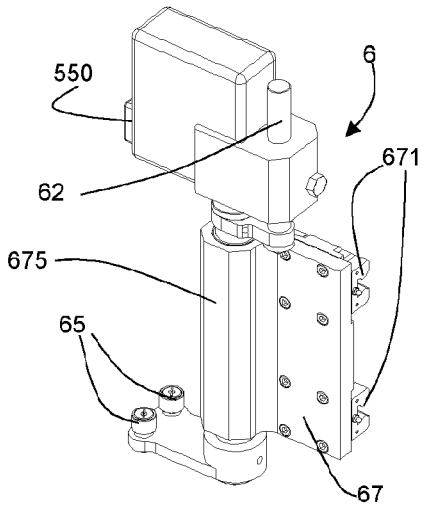
FIGS. 34 to 40 show different views of several components of the machine of FIG. 31.
Figure 35:
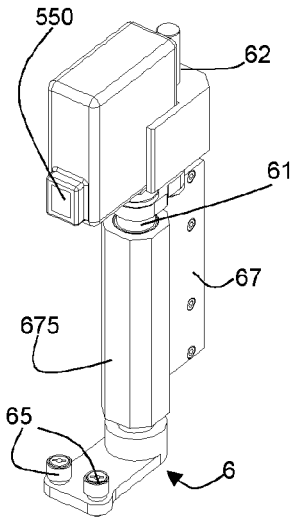
Figure 36:
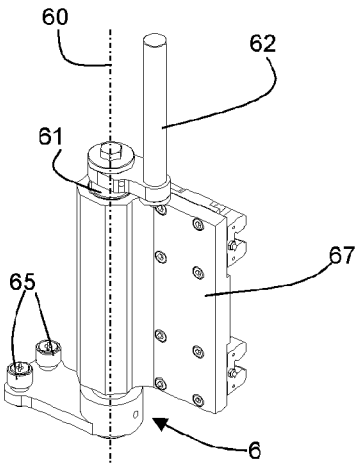
Figure 37:
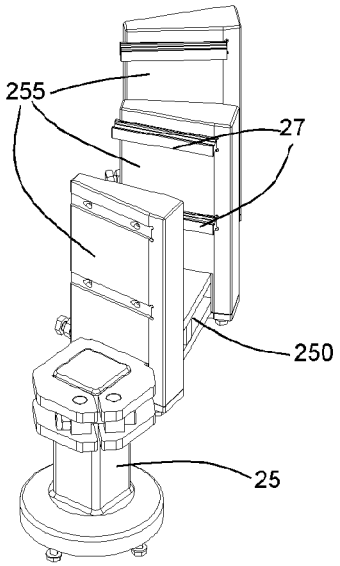
Figure 38:
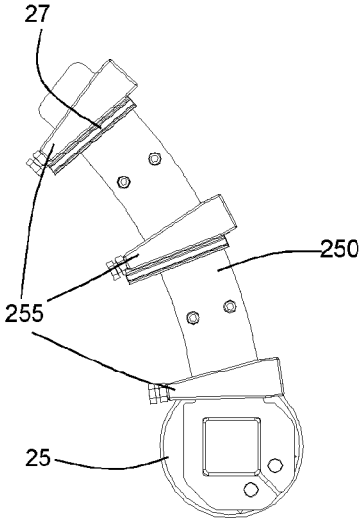
Figure 39:
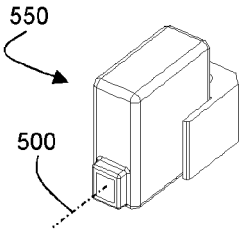
Figure 40:
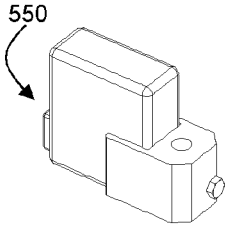

FIGS. 29 and 30 show the carrousel 3 after yet another rotation of 8.217 degrees about the first axis of rotation 30. The second sensor 55*b* is still pointing towards the centre of the bottle 9, even if the scan has been completed. In fact, the reference element 91 has crossed the working field of the second sensor 55*b* and gone beyond it by 18 degrees relative to the detecting line. The second sensor 55*b* has scanned 210 degrees of lateral surface, with a 30 degree overlap with the initial scan by the first sensor 55*a*.

The first sensor 55*a* is entering the curved stretch 371 for the next plate 4*b* and is about to begin detecting the bottle on the plate 4*b*. The entire lateral surface of the bottle 9 has been scanned by the combination of the two sensors 55*a*, 55*b*, with a 30 degrees overlap on each side. Therefore, the processing and control unit can identify the reference element 91 to determine the angular position of the bottle 9 on the plate 4*a*.

In the embodiments described above, each rotary support 6 supports an operating unit which is a detecting sensor 55, for performing a scan of the lateral surface of the bottles.

In a variant, a similar mechanical movement system may be used to perform an operation consisting of printing a graphical image on the lateral surface of the bottle (that is to say, on a label already applied or directly on the material of the bottle). In this variant, the operating unit mounted on the rotary support is a print head, for example of the ink jet type.

Said graphical image may, for example, be a use by date, a bar code, a small trademark symbol, a logo, a small label or even a substantially complete printing of the label.

Basically, the label could be produced directly on the container as if it were serigraphy.

Therefore, this machine variant can label a bottle by producing the label or part of it directly on the bottle, instead of applying a label that is already ready.

Similarly to detection of the reference element, the bottle is positioned on a rotating plate of the carrousel. The lateral surface of the bottle passes in front of the one or more print heads, which are positioned along the perimetric path of the carrousel. The rotation of the bottle and the movement of the rotary supports ensures that at least part of the lateral surface runs in front of each print head. The print head performs the printing during the step in which it follows the bottle, remaining oriented towards the centre of the bottle. As already described, during this step the distance between the printable surface and the print head remains constant.

Depending on requirements, the printing may be performed by a single print head, in which case there is only one rotary support. For example, this solution is used when the machine speed is low enough to allow the entire angular extent of the area to be printed to pass in front of a single print head.

For higher speeds, two or more print heads may be used (which are mounted on respective rotary supports), each of which prints a respective angular portion of the area to be printed.

A plurality of print heads may also be required for multi-coloured printing, if there is no print head available which is capable of printing multiple colours. In this case, the print heads are designed to print with colours which are different to each other. For example, each of them prints in one of the three basic colours and if necessary there is a further head for printing in black. In this configuration, the same area to be printed passes in sequence in front of the print heads, each of which prints with its own colour, thereby obtaining coloured printing by overlapping the individual colours printed.

A plurality of print heads may also be required for printing extending over a considerable height. In fact, print heads usually have a limit in terms of the height of the printable section. If the printing required exceeds said limit, it is possible to use print heads which are positioned at different heights to each other relative to the rotating plates. With this device, the print heads are designed to perform printing on respective regions of the lateral surface, said regions being at different heights to each other relative to the bottom of the bottle. This gives printing with the desired height. Essentially, when two or more print heads are used, the label is produced in multiple passes.

An embodiment of a printing labelling machine is shown in FIGS. 31 to 45, in which it is labelled 100.

The machine 100 is based on the labelling machine 10 described above. Therefore, only the significant differences compared with the labelling machine 10 are described in detail below. For all of the other details, reference should be made to the above description. Unless otherwise indicated, parts and elements having the same function in the machine 100 and in the machine 10 retain the same reference number.

In place of the detecting sensors 55, the machine 100 comprises print heads 550 (which in particular are of the ink jet type) which are mounted on the respective rotary supports 6 and therefore follow their movements of rotation about the axes 60 and translation relative to the linear guides 27. The print heads 550, which are removably mounted to allow their substitution, are part of a printing station 50 which at least partly acts as a labelling device.

Each print head 550 has its own operating line 500, or printing line, which basically corresponds to the line along which the ink is emitted. During printing, the movement of the rotary support 6 keeps the print head 550 with the operating line 500 pointing towards the bottle 9 to be labelled.

In the embodiment illustrated, the bracket 25 comprises three plates 255, which are angularly spaced from each other relative to the first axis of rotation 30. Therefore, the bracket 25 is designed to support three rotary supports 6 and three respective print heads 550. The three print heads 550 are at different heights for printing on three levels.

FIGS. 41 to 45 show a printing operation on the lateral surface of a bottle 9 on a rotating plate 4*a* during operation of the labelling machine 100. The movements are not described in detail again and reference should be made to what was described for the machines 1 and 10.

During the operations described below, the carrousel 3 and the rotating plates 4 rotate at a constant speed about the respective axes. The speeds of rotation are set in such a way that the bottle performs a complete 360 degree rotation while it is within the operating field of each print head.

The figures show a goniometer drawn on the rotating plate 4*a*, centred on the axis of rotation 40 of the plate 4*a*.

In the example, a front label is to be printed between 290 degrees and 70 degrees (therefore, extending for 140 degrees) and a rear label between 135 degrees and 225 degrees (therefore, extending for 90 degrees).

Figure 41:
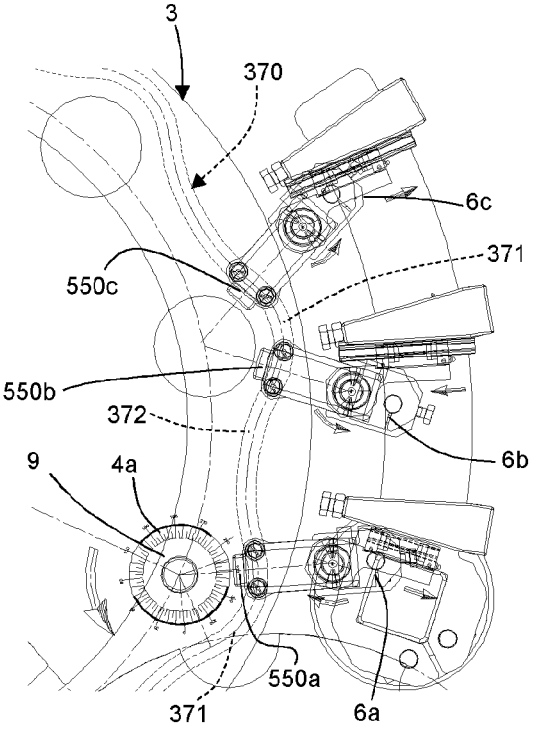
FIGS. 41 to 44 are schematic top views relative to an enlarged detail of the machine of FIG. 31, showing a sequence of positions during operation of the machine of FIG. 31, the position of FIG. 41 corresponding to the position of FIG. 31.

In FIG. 41, the bottle 9 on the plate 4*a* has entered the operating field of the first print head 550*a*, which has the operating line 500 directed towards the centre of the bottle and for example is oriented at 270 degrees on the goniometer. The second print head 550*b* and the third print head 550*c* are still directed towards the bottle on the previous plate 4.

Since the 290 degree angle for label start has not yet been reached, the first print head 550*a* waits another 20 degrees of rotation before it starts printing.

Figure 42:
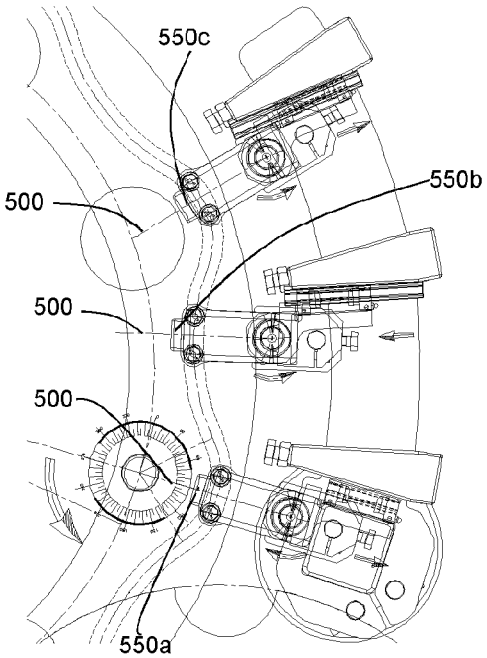

FIG. 42 shows the carrousel 3 after a rotation of 8.217 degrees about the first axis of rotation 30. The first print head 550*a* has kept its operating line 500 pointing towards the centre of the bottle 9 and is oriented at 90 degrees on the goniometer.

Therefore, in the stretch between FIGS. 41 and 42 the first print head 550*a* printed its full height of front label between 290 degrees and 70 degrees.

The second rotary support 6*b* has entered the connecting stretch 372 of the channel 370.

Figure 43:
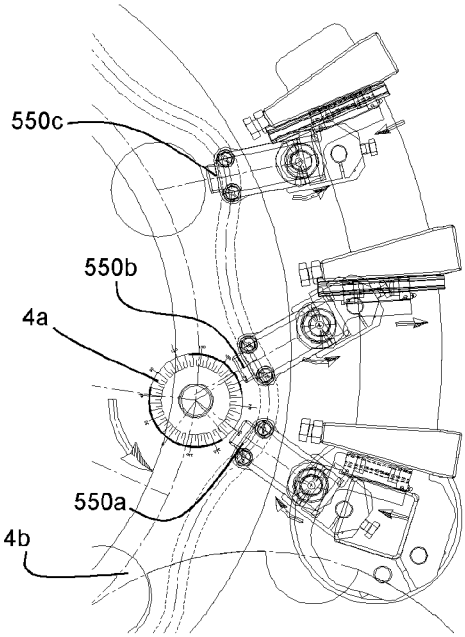

FIG. 43 shows the carrousel 3 after another rotation of 8.217 degrees about the first axis of rotation 30. The movements have continued in the directions indicated by the arrows. The first print head 550*a* has kept its operating line pointing towards the centre of the bottle 9 and is oriented at 270 degrees on the goniometer. Therefore, it has seen a complete rotation of the bottle 9 and has printed its part of rear label between 135 degrees and 225 degrees. The bottle 9 has also entered the operating field of the second print head 550*b*, which has its operating line 500 directed towards the centre of the bottle and for example is oriented at 195 degrees on the goniometer. The second print head 550*b* can therefore start printing its part of rear label.

Figure 44:
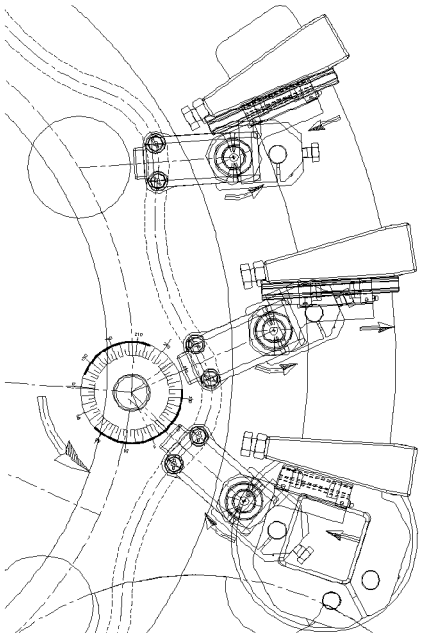
Figure 45:
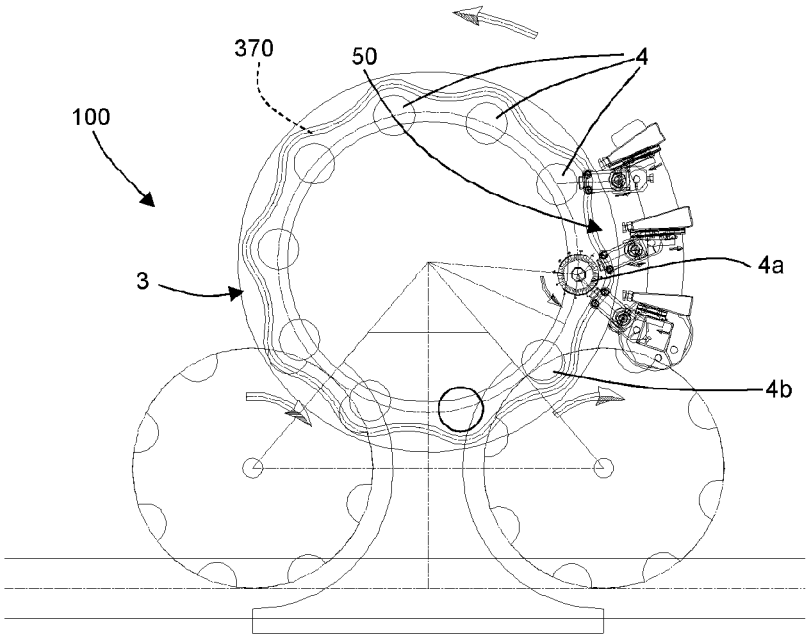
FIG. 45 is a schematic top view of the machine of FIG. 31, in the position of FIG. 44.

FIGS. 44 and 45 show the carrousel 3 after another rotation of 3.066 degrees about the first axis of rotation 30. The second print head 550*b* has kept its operating line pointing towards the centre of the bottle 9 and is oriented at 270 degrees on the goniometer, like the first print head 550*a* at the start of the sequence in FIG. 41. During the subsequent steps, the second print head 550*b* continues printing its part of front and rear labels. The first print head 550*a* moves to prepare to print on the bottle on the next plate 4*b*.

When the bottle 9 on the plate 4*a* is in the operating field of the third print head 550*c*, the latter prints its part of labels, completing the operations for producing the label at the three levels into which it was divided.

Alternatively to the labelling machine 100 described above, in which the at least one print head is positioned outside the carrousel, a printing labelling machine may be produced with the at least one print head positioned inside the carrousel. In other words, a printing labelling machine may be based on the machine 1 described above, with print heads in place of the detecting sensors 55.

Finally, it should be noticed that this invention is relatively easy to produce and that even the cost linked to implementing the invention is not very high.

The invention described above may be modified and adapted in several ways without thereby departing from the scope of the inventive concept.

Moreover, all details of the invention may be substituted with other technically equivalent elements and in practice all of the materials used, as well as the shapes and dimensions of the various components may vary according to requirements.

The invention claimed is:

1. A labelling machine (1; 10; 100) comprising:

a supporting frame (2);

a carrousel (3) rotatably mounted on the supporting frame (2) in such a way that the carrousel (3) can rotate about a first axis of rotation (30);

a plurality of supporting elements (4) for articles to be labelled (9), the supporting elements (4) being mounted on the periphery of the carrousel (3), each supporting element (4) being able to rotate relative to the carrousel (3) about a respective second axis of rotation (40);

one or more motor devices (39, 49) designed to move the carrousel (3) relative to the supporting frame (2) and to move the supporting elements (4) relative to the carrousel (3);

a feed station (16) for feeding the articles to be labelled (9) to the supporting elements (4) and a pickup station (17) for picking up the labelled articles (9) from the supporting elements (4);

an operating unit (55; 550) having an operating line (50; 500), the operating unit (55; 550) being designed to perform an operation on a lateral surface of an article (9) which is located on said operating line (50; 500), said operation being related to labelling the article (9), wherein the operating unit (55; 550) is mounted on a rotary support (6) which is mounted on the supporting frame (2), the rotary support (6) being able to rotate about a third axis of rotation (60) which is at a distance, along a radial line, from the first axis of rotation (30), the operating unit (55; 550) being rotatable together with the rotary support (6) and the carrousel (3) being movable relative to the third axis of rotation (60), wherein, in use, an article to be labelled (9) is positioned on a respective supporting element (4), which passes near to the operating unit (55; 550) during the rotation of the carrousel (3) about the first axis of rotation (30), and the rotation of the rotary support (6) about the third axis of rotation (60) is coordinated with the rotation of the carrousel (3) about the first axis of rotation (30), so that the rotation of the rotary support (6) about the third axis of rotation (60) keeps the operating unit (55; 550) with the operating line (50; 500) towards said article to be labelled (9), so that the operating unit (55; 550) follows the article (9) along a stretch of angular movement of the carrousel (3) about the first axis of rotation (30) during the rotation of the carrousel (3) about the first axis of rotation (30).

2. The labelling machine (1) according to claim 1, wherein the rotary support (6) is positioned inside the carrousel (3), the third axis of rotation (60) being located between the first axis of rotation (30) and the periphery of the carrousel (3), the labelling machine (1) being designed in such a way that, in use, the carrousel (3) rotates about the first axis of rotation (30) with a first direction of rotation, each supporting element (4) rotates about the respective second axis of rotation (40) with a second direction of rotation which is opposite to the first direction of rotation, the rotary support (6) during operation of the operating unit (55) rotates about the third axis of rotation (60) with a third direction of rotation which is the same as the first direction of rotation and is opposite to the second direction of rotation.

3. The labelling machine (10; 100) according to claim 1, wherein the rotary support (6) is positioned outside the carrousel (3), the periphery of the carrousel (3) passing through a region between the first axis of rotation (30) and the third axis of rotation (60), the labelling machine (10; 100) being designed in such a way that, in use, the carrousel (3) rotates about the first axis of rotation (30) with a first direction of rotation, each supporting element (4) rotates about the respective second axis of rotation (40) with a second direction of rotation which is the same as the first direction of rotation, the rotary support (6) during operation of the operating unit (55; 550) rotates about the third axis of rotation (60) with a third direction of rotation which is opposite to the first direction of rotation and to the second direction of rotation.

4. The labelling machine (1; 10; 100) according to claim 1, wherein the rotary support (6) is movable relative to the supporting frame (2), the third axis of rotation (60) being able to translate relative to the first axis of rotation (30), the translation of the third axis of rotation (60) being coordinated with the rotation of the carrousel (3) about the first axis of rotation (30), whereby, in use, a distance between the operating unit (55; 550) and the second axis of rotation (40) of the respective supporting element (4) is kept constant along said stretch of angular movement of the carrousel (3) about the first axis of rotation (30).

5. The labelling machine (1; 10; 100) according to claim 1, wherein the rotation of the rotary support (6) about the third axis of rotation (60) is an oscillating movement, the rotary support (6) performing an outward angular stroke and a return angular stroke which is in the opposite direction to the outward angular stroke.

6. The labelling machine (1; 10; 100) according to claim 5, comprising an annular guide (35; 350) fixed to the carrousel (3) and having an undulating profile, the rotary support (6) being designed to operate in conjunction with the annular guide (35; 350) during the rotation of the carrousel (3) through a follower member which follows the undulating profile, the oscillating movement of the rotary support (6) being determined by its operation in conjunction with the annular guide (35; 350).

7. The labelling machine (1; 10; 100) according to claim 6, wherein the follower member of the rotary support (6) comprises two idle wheels (65) which are angularly spaced from each other relative to the third axis of rotation (60), the two idle wheels (65) being in contact with the annular guide (35; 350) and being designed to follow the undulating profile during the rotation of the carrousel (3).

8. The labelling machine (1; 10; 100) according to claim 7, wherein said annular guide (35; 350) comprises a channel (37; 370) having said undulating profile and the two idle wheels (65) are positioned in said channel (37; 370).

9. The labelling machine (1; 10; 100) according to claim 6, wherein the undulating profile comprises a plurality of curved stretches (371) each having a concavity facing towards the second axis of rotation (40) of said respective supporting element (4), each of said curved stretches (371) being an arc of a circle with its centre on the second axis of rotation (40) of the respective supporting element (4).

10. The labelling machine (1; 10; 100) according to claim 6, wherein the rotary support (6) pivots at a slide (67) which is slidably mounted on a linear guide (27) fixed to the supporting frame (2), said linear guide (27) extending along a line which is substantially radial relative to the first axis of rotation (30), wherein, in use, the slide (67) is designed to slide on said linear guide (27) with a reciprocating movement which is determined by the rotary support (6) operating in conjunction with the annular guide (35; 350).

11. The labelling machine (1; 10; 100) according to claim 6, comprising a plurality of said rotary supports (6), which are mounted on the supporting frame (2) in regions that are angularly spaced from each other relative to the first axis of rotation (30), each rotary support (6) being able to rotate about a respective third axis of rotation (60), the labelling machine (1; 10; 100) also comprising a plurality of said operating units (55; 550), each mounted on a respective rotary support (6), wherein, in use, said respective supporting element (4) passes near to the operating units (55; 550) one after another during the rotation of the carrousel (3) and each of said operating units (55; 550) performs an operation on a respective portion of the lateral surface of the article (9) positioned on said respective supporting element (4), wherein the rotary supports (6) are designed to operate in conjunction with the same annular guide (35; 350) during the rotation of the carrousel (3), the follower members being positioned in successive stretches of said undulating profile, the rotary supports (6) performing oscillating movements which are out of phase from one another.

12. The labelling machine (1; 10; 100) according to claim 1, comprising a plurality of said rotary supports (6), which are mounted on the supporting frame (2) in regions that are angularly spaced from each other relative to the first axis of rotation (30), each rotary support (6) being able to rotate about a respective third axis of rotation (60), the labelling machine (1; 10; 100) also comprising a plurality of said operating units (55; 550), each mounted on a respective rotary support (6), wherein, in use, said respective supporting element (4) passes near to the operating units (55; 550) one after another during the rotation of the carrousel (3) and each of said operating units (55; 550) performs operations on respective portions of the lateral surface of the article (9) positioned on said respective supporting element (4).

13. The labelling machine (1; 10; 100) according to claim 12, wherein said respective portions of the lateral surface of the article (9) are angular stretches of the lateral surface and partly overlap one another, said angular stretches together covering more than 360 degrees.

14. The labelling machine (1; 10) according to claim 1, wherein said operating unit is a detecting sensor (55) and said operation is a scan of the lateral surface of the article (9) for detecting a reference element (91) on said lateral surface.

15. The labelling machine (1; 10) according to claim 14, wherein the detecting sensor (55) comprises an optical fibre or a photocell or a video camera, the labelling machine (1; 10) also comprising a processing unit designed to determine an angular position of the article (9) positioned on the respective supporting element (4) based on what was detected by the detecting sensor (55).

16. The labelling machine (100) according to claim 1, wherein said operating unit is a print head (550) and said operation is printing of a graphical image on the lateral surface of the article (9) positioned on the respective supporting element (4).

17. The labelling machine (100) according to claim 16, comprising a plurality of said rotary supports (6), which are mounted on the supporting frame (2) in regions that are angularly spaced from each other relative to the first axis of rotation (30), each rotary support (6) being able to rotate about a respective third axis of rotation (60), the labelling machine (100) also comprising a plurality of said print heads (550), each mounted on a respective rotary support (6) and designed to perform printing on the lateral surface of the article positioned on the respective supporting element (4) which passes near to the print heads (550) one after another during the rotation of the carrousel (3), said print heads (550) being designed to print with colours which are different to each other.

18. The labelling machine (100) according to claim 16, comprising a plurality of said rotary supports (6), which are mounted on the supporting frame (2) in regions that are angularly spaced from each other relative to the first axis of rotation (30), each rotary support (6) being able to rotate about a respective third axis of rotation (60), the labelling machine (100) also comprising a plurality of said print heads (550), each mounted on a respective rotary support (6) and designed to perform printing on the lateral surface of the article (9) positioned on the respective supporting element (4) which passes near to the print heads (550) one after another during the rotation of the carrousel (3), said print heads (550) being positioned at different heights to one another relative to the supporting elements (4) and being designed to perform printing on respective regions of the lateral surface of the article (9), said regions being at different heights to one another relative to the bottom of the article (9).

19. The labelling machine (1; 10) according to claim 1, wherein said operation related to labelling the article (9) is an operation of scanning the lateral surface of the article (9) to detect a reference element, thereby determining an angular position of the article (9) and allowing a precise label application in a desired position.

20. The labelling machine (100) according to claim 1, wherein said operation related to labelling the article (9) is a printing operation on the lateral surface of the article (9), thereby producing a label or part of it directly on the article (9).

* * * * *